US011072175B2

(12) United States Patent
Watanabe

(10) Patent No.: US 11,072,175 B2
(45) Date of Patent: Jul. 27, 2021

(54) LIQUID EJECTING HEAD AND LIQUID EJECTING APPARATUS

(71) Applicant: SEIKO EPSON CORPORATION, Tokyo (JP)

(72) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/935,473

(22) Filed: Jul. 22, 2020

(65) Prior Publication Data

US 2021/0023842 A1 Jan. 28, 2021

(30) Foreign Application Priority Data

Jul. 25, 2019 (JP) ..... JP2019-137144

(51) Int. Cl.
*B41J 2/145* (2006.01)

(52) U.S. Cl.
CPC ..... *B41J 2/145* (2013.01)

(58) Field of Classification Search
CPC ..... B41J 2/145
See application file for complete search history.

(56) References Cited

U.S. PATENT DOCUMENTS

| | | | | |
|---|---|---|---|---|
| 9,434,167 | B2 * | 9/2016 | Hagiwara | B41J 2/1752 |
| 10,933,670 | B2 * | 3/2021 | Kobayashi | B41J 2/16517 |
| 2011/0242190 | A1 | 10/2011 | Suzuki et al. | |

FOREIGN PATENT DOCUMENTS

| | | | |
|---|---|---|---|
| JP | 2004-122395 | A | 4/2004 |
| JP | 2007-260948 | A | 11/2007 |
| JP | 2008-238752 | A | 10/2008 |
| JP | 2009-184179 | A | 8/2009 |
| JP | 2011-207181 | A | 10/2011 |
| JP | 2012-166420 | A | 9/2012 |
| JP | 2012-176579 | A | 9/2012 |
| JP | 2013-099893 | A | 5/2013 |
| JP | 2015-189139 | A | 11/2015 |

* cited by examiner

*Primary Examiner* — Lamson D Nguyen
(74) *Attorney, Agent, or Firm* — Workman Nydegger

(57) ABSTRACT

A liquid ejecting head includes a nozzle plate provided with nozzles configured to eject a liquid in a first direction; a case provided in a second direction that is opposite to the first direction with respect to the nozzle plate, and having a flow path pipe that defines a first flow path through which the liquid flows and which protrudes in the second direction; a circuit substrate provided in the second direction with respect to the case and having a first through-hole through which the flow path pipe penetrates; a first seal member provided in the second direction with respect to the circuit substrate; a holder provided in the second direction with respect to the first seal member and having therein a second flow path communicating with the first flow path; a screw fixing the holder to the case; and an adhesive fixing the holder to the case.

20 Claims, 24 Drawing Sheets

LIQUID EJECTING HEAD AND LIQUID EJECTING APPARATUS

The present application is based on, and claims priority from JP Application Serial Number 2019-137144, filed Jul. 25, 2019, the disclosure of which is hereby incorporated by reference herein in its entirety.

BACKGROUND

1. Technical Field

The present disclosure relates to a liquid ejecting head and a liquid ejecting apparatus.

2. Related Art

A liquid ejecting apparatus such as a printer includes a liquid ejecting head ejecting a liquid onto a recording medium or the like. For example, JP-A-2015-189139 discloses a liquid ejecting head in which a first seal member and a wiring substrate are disposed between a holder and a case, and the holder and the case are fixed with fixing screws.

However, according to the technique described in JP-A-2015-189139, when a fastening force of the fixing screw is decreased, sealing performance between the holder and the case may be decreased.

SUMMARY

According to one embodiment of the present disclosure, a liquid ejecting head is provided. The liquid ejecting head includes: a nozzle plate provided with a plurality of nozzles ejecting a liquid in a first direction; a case provided in a second direction that is opposite to the first direction with respect to the nozzle plate, and having a flow path pipe that defines a first flow path through which the liquid flows and which protrudes in the second direction; a circuit substrate provided in the second direction with respect to the case and having a first through-hole through which the flow path pipe penetrates; a first seal member provided in the second direction with respect to the circuit substrate; a holder provided in the second direction with respect to the first seal member and having therein a second flow path communicating with the first flow path; a screw fixing the holder to the case; and an adhesive fixing the holder to the case.

DESCRIPTION OF EXEMPLARY EMBODIMENTS

A. First Embodiment

Figure 1:
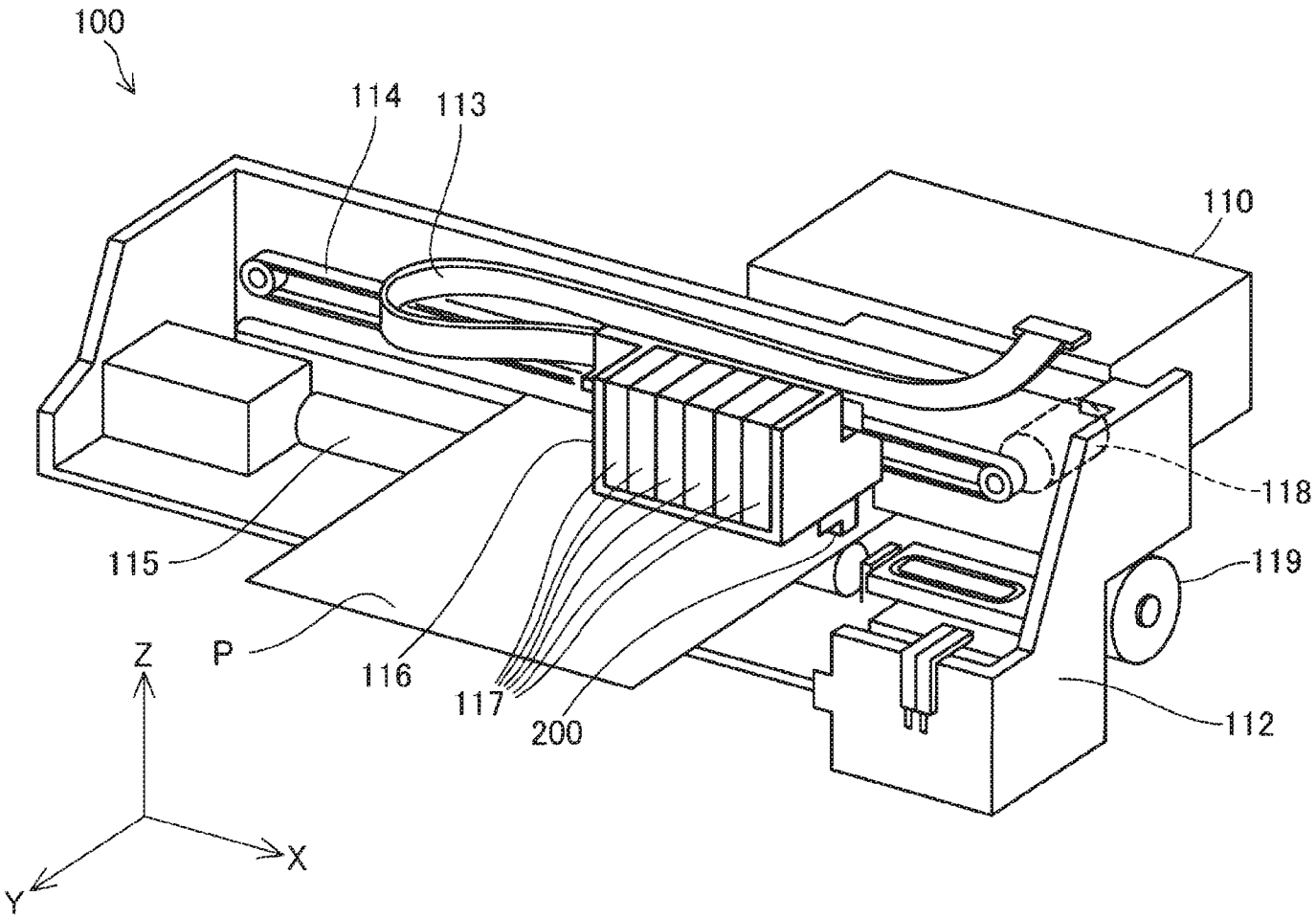
FIG. 1 is an explanatory view illustrating a schematic configuration of a liquid ejecting apparatus including a liquid ejecting head according to an embodiment of the present disclosure.

A1. Configuration of Liquid Ejecting Apparatus:

FIG. 1 is an explanatory view illustrating a schematic configuration of a liquid ejecting apparatus 100 including a liquid ejecting head 200 according to an embodiment of the present disclosure. The liquid ejecting apparatus 100 is configured as an ink jet printer ejecting ink. The liquid ejecting apparatus 100 converts image data received from a liquid ejecting control device (not illustrated) into print data indicating ON/OFF of dots on a print medium P, and ejects ink onto the print medium P based on the print data to form dots on the print medium P and print an image.

The liquid ejecting apparatus 100 includes the liquid ejecting head 200, a carriage 116, six ink cartridges 117, a carriage motor 118, a transport motor 119, a drive belt 114, a flexible flat cable 113, a platen 115, a control section, 110 and a housing 112.

The liquid ejecting head 200 is mounted on the carriage 116 and is electrically coupled to the control section 110 via the flexible flat cable 113. The carriage 116 is attached to a carriage guide (not illustrated) so as to be capable of reciprocating in a main scanning direction X. The carriage 116 is coupled to the carriage motor 118 via the drive belt 114, and reciprocates in the main scanning direction X as the carriage motor 118 rotates. The housing 112 accommodates the liquid ejecting head 200, the carriage 116, the six ink cartridges 117, the carriage motor 118, the transport motor 119, the drive belt 114, the flexible flat cable 113, and the platen 115. In FIG. 1, a part of the housing 112 is not illustrated to make it easy to see an internal configuration of the housing 112. The housing 112 may be configured to accommodate the control section 110.

The carriage 116 is equipped with the six ink cartridges 117 for respective ink colors. In the present embodiment, the six ink cartridges 117 accommodate cyan, light cyan, magenta, light magenta, yellow, and black inks, respectively. The liquid ejecting head 200 is provided with a nozzle row 281 including a plurality of nozzles 282 ejecting ink onto a facing surface of the print medium P. The ink supplied from the ink cartridge 117 to the liquid ejecting head 200 is ejected from the nozzle 282 onto the print medium P in a form of droplets. The ink cartridge 117 is an example of a "liquid storage section".

The transport motor 119 operates according to a control signal from the control section 110. By transmitting power of the transport motor 119 to the platen 115, the print medium P is transported in a sub-scanning direction Y.

The control section 110 includes a processing circuit such as one or a plurality of central processing units (CPUs) and a field programmable gate array (FPGA), and a storage circuit such as a semiconductor memory. The control section 110 performs overall control of the transport motor 119 and the carriage 116. Specifically, when a generation of the print data is completed, the control section 110 drives the transport motor 119 to transport the print medium P to a print start position in the sub-scanning direction Y. The control section 110 drives the carriage motor 118 to move the carriage 116 to the print start position in the main scanning direction X. The control section 110 alternately repeats the control of moving the carriage 116 in the main scanning direction X and ejecting the ink from the liquid ejecting head 200 onto the print medium P, and the control of the transport motor 119 to transport the print medium P in the sub-scanning direction Y that is a print direction. Thereby, an image is printed on the print medium P.

In FIG. 1, the carriage 116 reciprocates in the main scanning direction X, and the print medium P is transported from upstream to downstream in the sub scanning direction Y intersecting the main scanning direction X. In the present embodiment, the sub-scanning direction Y is a direction orthogonal to the main scanning direction X. A Z-axis is parallel to a vertical direction. In these directions, a direction indicated by an arrow indicates "+", and a direction opposite to the direction indicated by the arrow indicates "−". Arrows indicating respective directions are also illustrated in the drawings referred to later, similarly to FIG. 1. In the following description, a −Z direction is also referred to as a first direction D1, a +Z direction as a second direction D2, a Y direction as a third direction D3, and an X direction as a fourth direction D4. The −Z direction corresponds to vertically downward, and the +Z direction corresponds to vertically upward.

Figure 2:
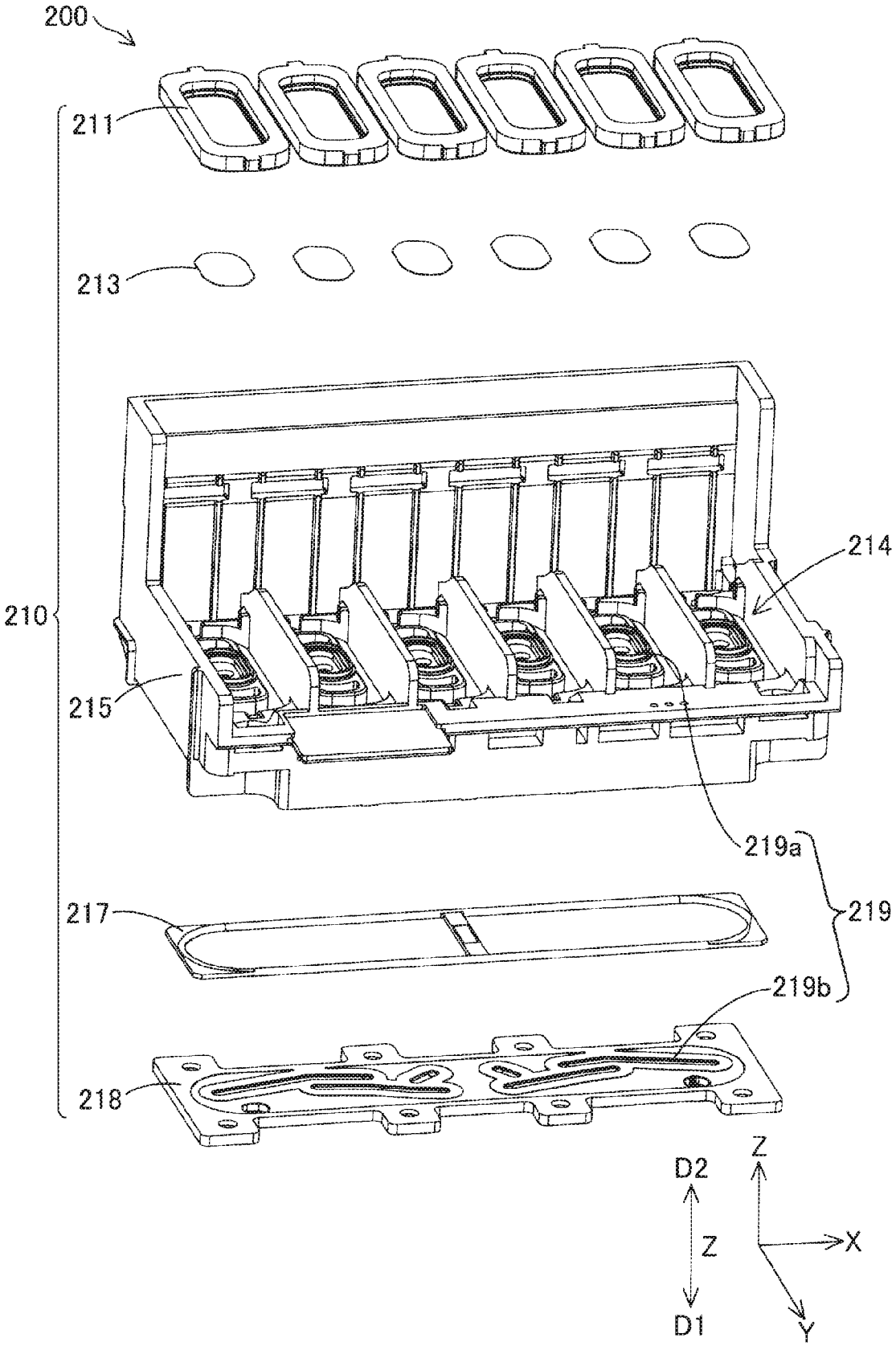
FIG. 2 is an exploded perspective view illustrating a schematic configuration of the liquid ejecting head.
Figure 3:
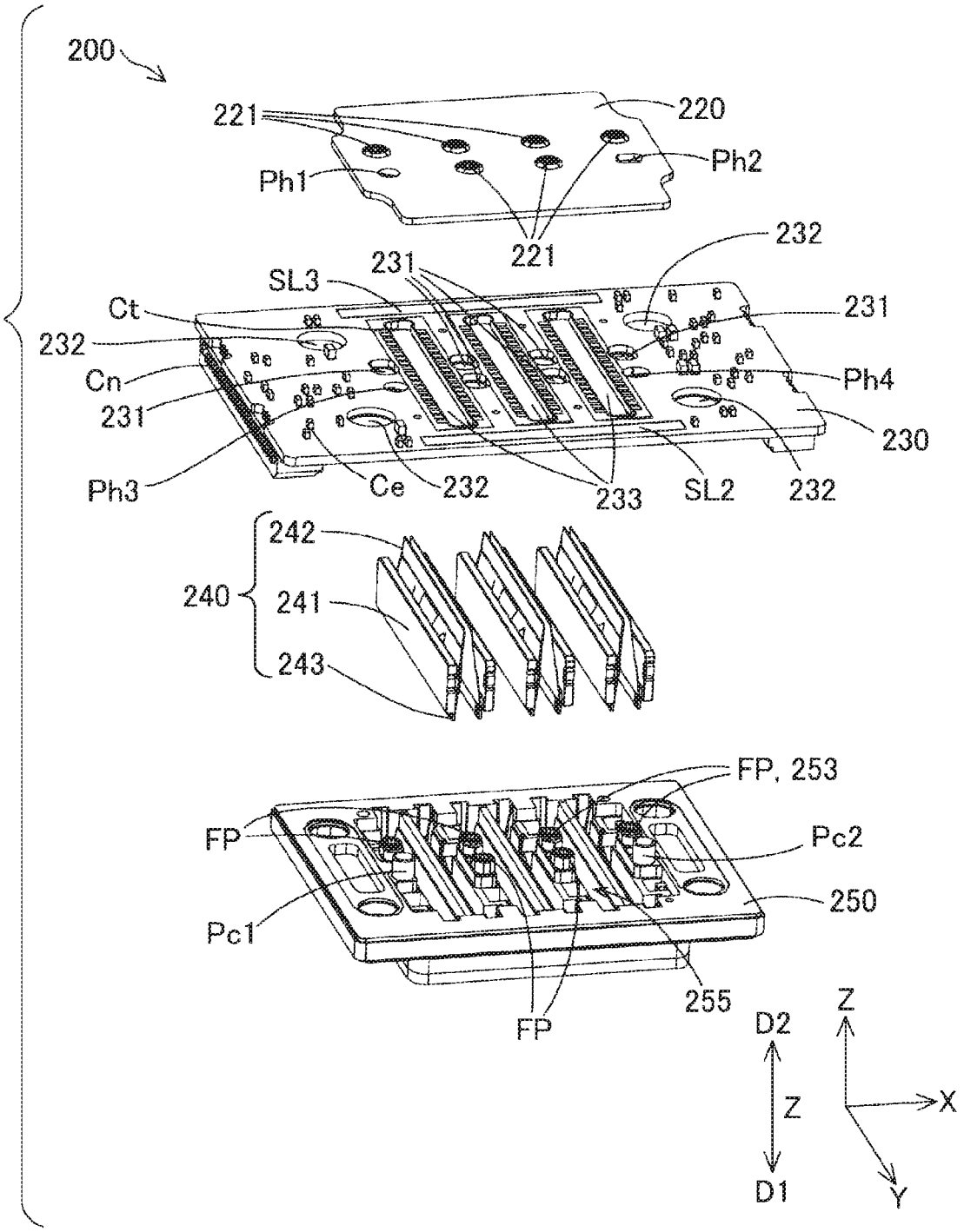
FIG. 3 is an exploded perspective view illustrating a schematic configuration of the liquid ejecting head.
Figure 4:
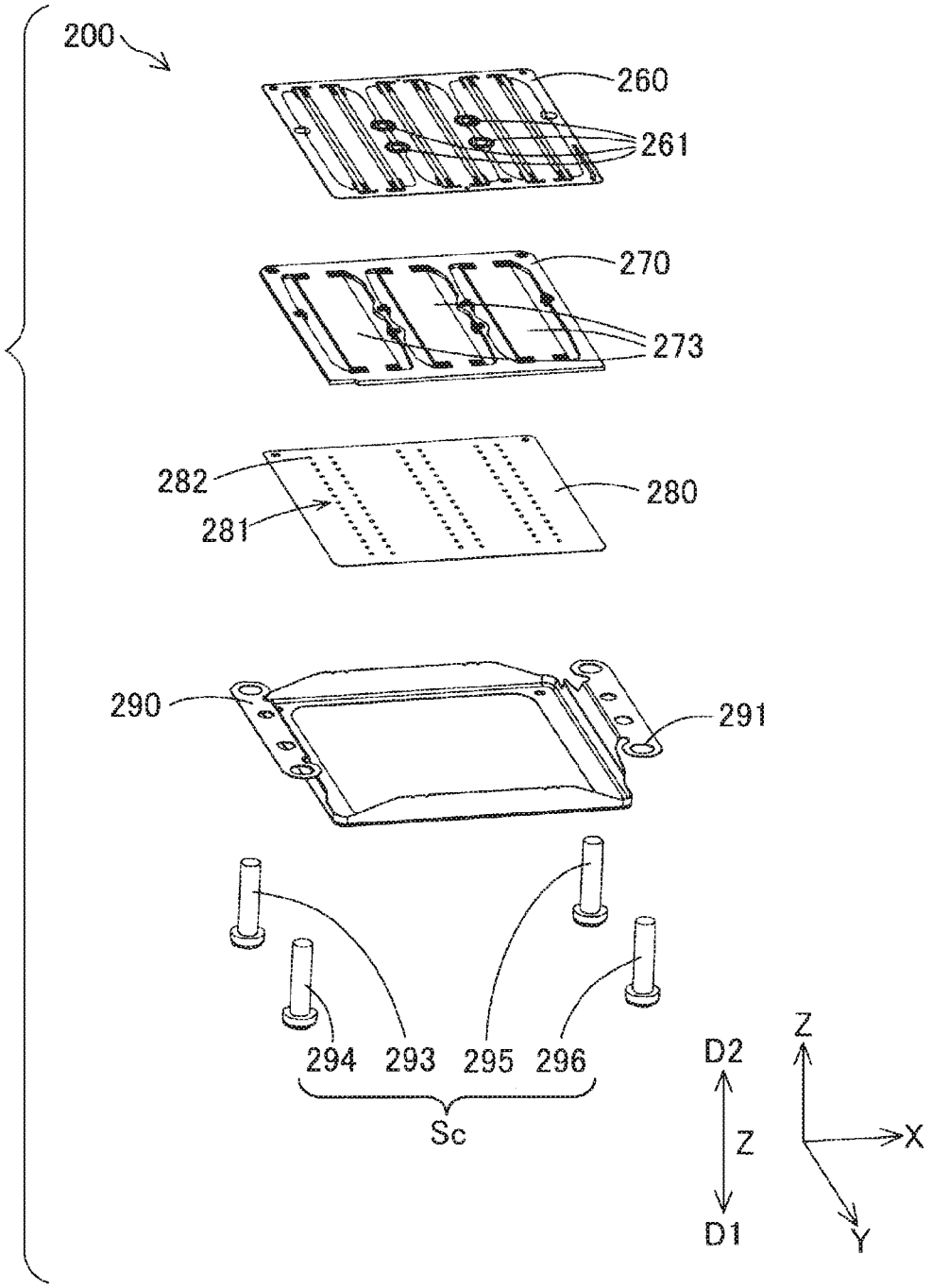
FIG. 4 is an exploded perspective view illustrating a schematic configuration of the liquid ejecting head.

A2. Configuration of Liquid Ejecting Head:

FIGS. 2, 3 and 4 are exploded perspective views illustrating a schematic configuration of the liquid ejecting head 200. As illustrated in FIGS. 2, 3, and 4, the liquid ejecting head 200 sequentially includes a holder 210, a first seal member 220, a circuit substrate 230, an actuator unit 240, a case 250, a vibration plate 260, a flow path forming member 270, a nozzle plate 280, and a cover 290, in order from the second direction D2 to the first direction D1. The liquid ejecting head 200 is configured by stacking these respective configuration members and fastening them with four screws 293, 294, 295, and 296. Therefore, it can be said that the liquid ejecting head 200 includes the four screws 293, 294, 295, and 296.

As illustrated in FIG. 2, the holder 210 holds the ink cartridge 117 in cooperation with the carriage 116, and allows the ink supplied from the ink cartridge 117 to flow into the case 250 via a second flow path 219 formed therein. The holder 210 includes a body portion 215, a first seal 211, a filter 213, a second seal 217, and a flow path plate 218.

The body portion 215 includes a mounting portion 214 of the ink cartridge 117 and a flow path 219*a* configuring a part of the second flow path 219. The second flow path 219 is configured of the flow path 219*a*, and flow paths 219*b* and 219*c* described later. The ink cartridge 117 is mounted on the mounting portion 214, and a claw portion (not illustrated) provided on the ink cartridge 117 is engaged with an engaging hole (not illustrated) provided on the mounting portion 214, thereby fixing the ink cartridge 117. Six mounting portions 214 are formed side by side in the X direction. Each mounting portion 214 is partitioned by a wall provided in parallel in the Y direction. The flow path 219*a* is defined by a cylindrical member protruding in the second direction D2. The first seal 211 is an annular plate-like member, and includes a through-hole penetrating in the Z direction. The first seal 211 liquid-tightly seals a periphery of the flow path 219*a* between an ink inlet (not illustrated) provided in the ink cartridge 117 and the flow path 219*a*. A groove (not illustrated) that defines the flow path 219*b* described below is provided on a surface of the body portion 215 on a first direction D1 side.

The filter 213 removes bubbles and foreign substances contained in the ink supplied from the ink cartridge 117. The filter 213 has a disk shape, and is fixed to an opening surface of the flow path 219*a* on a second direction D2 side by heat welding, bonding with an adhesive, or the like. As the filter 213, it is possible to use a sheet-like member in which a plurality of fine holes are formed by finely knitting a metal or a fiber such as a resin, or a member obtained by forming a plurality of fine holes penetrating a plate-like member such as a metal or a resin.

Figure 6:
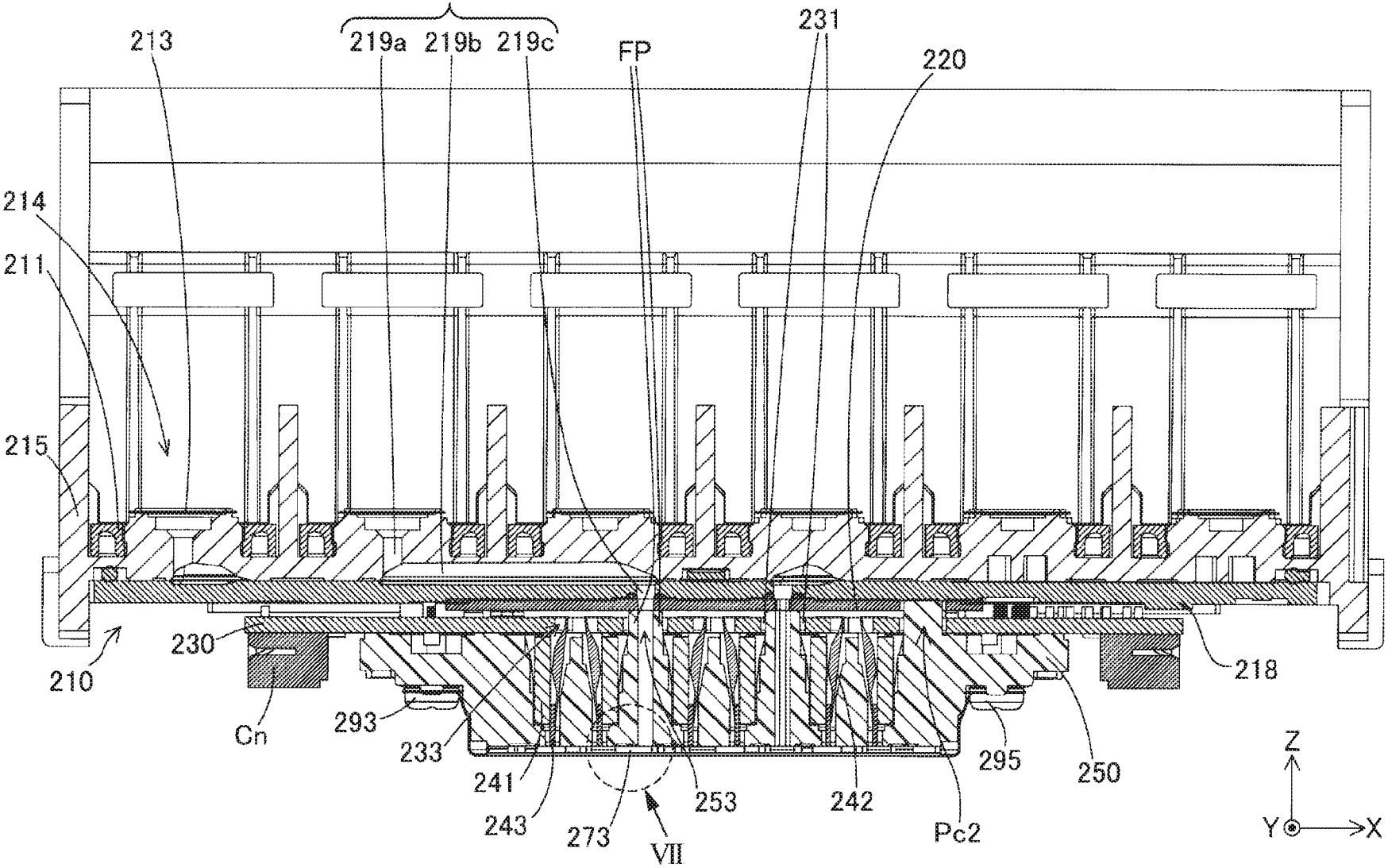
FIG. 6 is a sectional view of the liquid ejecting head, which is taken along line VI-VI in FIG. 5.

The flow path plate 218 is a plate-like member that is elongated in the X direction, and includes a groove that defines the flow path 219*b* configuring a part of the second flow path 219, and a through-hole that defines the flow path 219*c* configuring a part of the second flow path 219. The flow path 219*b* is formed by sealing together a groove extending in the X direction on a surface of the flow path plate 218 on the second direction D2 side and a groove extending in the X direction on a surface of the body portion 215 on the first direction D1 side. The flow path 219*b* communicates, at one end, with the flow path 219*a* and, at the other end, with the flow path 219*c*. The flow path 219*c* is a through-hole that penetrates the flow path plate 218 in the Z direction at a portion where the other end of the flow path 219*b* is located (FIG. 6).

As described above, the flow path 219*a* allows the ink supplied from the ink cartridge 117 to flow into the flow path 219*b*, and the flow path 219*b* allows the ink flowing from the flow path 219*a* to flow into the flow path 219*c*. The flow path 219*c* allows the ink flowing from the flow path 219*b* to flow into a first flow path 253 described later formed in the case 250 via an ink inlet 221 of the first seal member 220 described later.

The second seal 217 includes a through-hole penetrating the second seal 217 in the Z direction, and liquid-tightly seals a periphery of a portion where the flow path 219*b* is formed.

As illustrated in FIG. 3, the first seal member 220 is a substantially rectangular plate-like member that is elongated in the X direction. The first seal member 220 is configured of, for example, an elastic member such as rubber or elastomer. In the first seal member 220, the ink inlets 221 and positioning through-holes Ph1 and Ph2 are formed. The positioning through-holes Ph1 and Ph2 are through-holes which penetrate the first seal member 220 in the Z direction, and into which positioning protrusion portions Pc1 and Pc2 included in the case 250 described later are inserted. The positioning through-holes Ph1 and Ph2 function as positioning portions when respective configuration members of the liquid ejecting head 200 are joined together by inserting positioning protrusion portions Pc1 and Pc2 described later included in the case 250 into the positioning through-holes Ph1 and Ph2.

The ink inlet 221 is a through-hole penetrating the first seal member 220 in the Z direction, and allows the second flow path 219 of the body portion 215 illustrated in FIG. 2 to communicate with the first flow path 253 of the flow path pipe FP illustrated in FIG. 3, and the ink supplied from the ink cartridge 117 to flow into the case 250. When the respective configuration members of the liquid ejecting head 200 are stacked and fastened, the first seal member 220 is pinched in a state where a predetermined pressing force is applied between the holder 210 and the flow path pipe FP of the case 250 illustrated in FIG. 3. Therefore, the first seal member 220 liquid-tightly seals between the second flow path 219 of the holder 210 and the first flow path 253 of the flow path pipe FP. Specifically, the first seal member 220 allows an opening of the through-hole that forms the flow path 219*c*, which is provided on the surface of the flow path plate 218 on the first direction D1 side, to liquid-tightly communicate with the ink inlet 221. Further, the first seal member 220 allows the first flow path 253 to liquid-tightly communicate with the ink inlet 221.

The circuit substrate 230 is a substantially rectangular plate-like member that is elongated in the X direction. As illustrated in FIGS. 2 and 3, the circuit substrate 230 is disposed between the holder 210 and the case 250, and as illustrated in FIG. 3, is disposed adjacent to the first seal member 220 on the first direction D1 side. The circuit substrate 230 is fixed to the surface of the case 250 on the second direction D2 side by, for example, an adhesive. The circuit substrate 230 is an electronic substrate on which a drive circuit for driving a piezoelectric body 243 described later included in the actuator unit 240, a circuit element Ce, wiring, and the like are integrated. The circuit substrate 230 includes the circuit element Ce, the first through-hole 231, the second through-hole 232, openings 233, a coupling terminal Ct, positioning through-holes Ph3 and Ph4, and a connector Cn.

The circuit element Ce is a discrete component such as a resistor, a capacitor, a transistor, or a coil. The circuit element Ce is three-dimensionally stacked on a surface of the circuit substrate 230 on the second direction D2 side. In the present embodiment, t "the circuit element Ce is three-dimensionally stacked on the circuit substrate 230" means that the circuit element Ce is stacked on the circuit substrate 230, in such a manner that the circuit element Ce protrudes from the surface of the circuit substrate 230 on the second direction D2 side in the second direction D2, for example, by 0.4 mm or more.

The first through-hole 231 is a through-hole that penetrates the circuit substrate 230 in the Z direction. The first through-hole 231 is provided at a position overlapping with the ink inlet 221 of the first seal member 220 when viewed in the second direction D2, and is provided at a position overlapping with the flow path pipe FP described later included in the case 250 when viewed in the first direction D1. A size of an inner circumference of the first through-hole 231 is larger than a size of an outer circumference of the flow path pipe FP. In other words, an inner diameter of the first through-hole 231 is larger than an outer diameter of the flow path pipe FP. Therefore, when the flow path pipe FP is inserted into the first through-hole 231, the flow path pipe FP protrudes in the second direction D2 from the surface of the circuit substrate 230 on the second direction D2 side. The above "viewed in the second direction D2" means that the circuit substrate 230 is viewed in plan view in the second direction D2.

Figure 15:
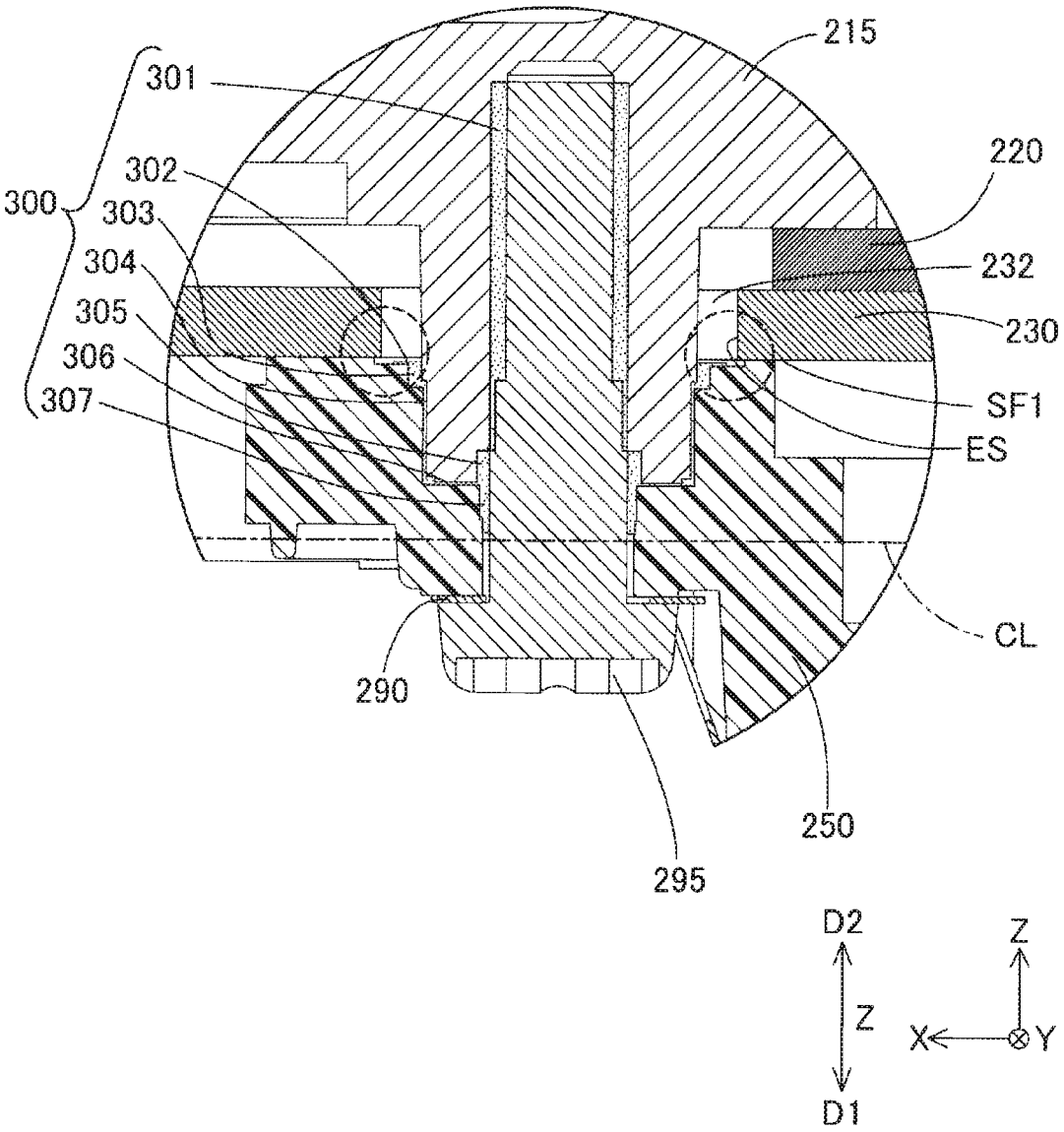
FIG. 15 is an enlarged view of a region XV illustrated in FIG. 13.
Figure 16:
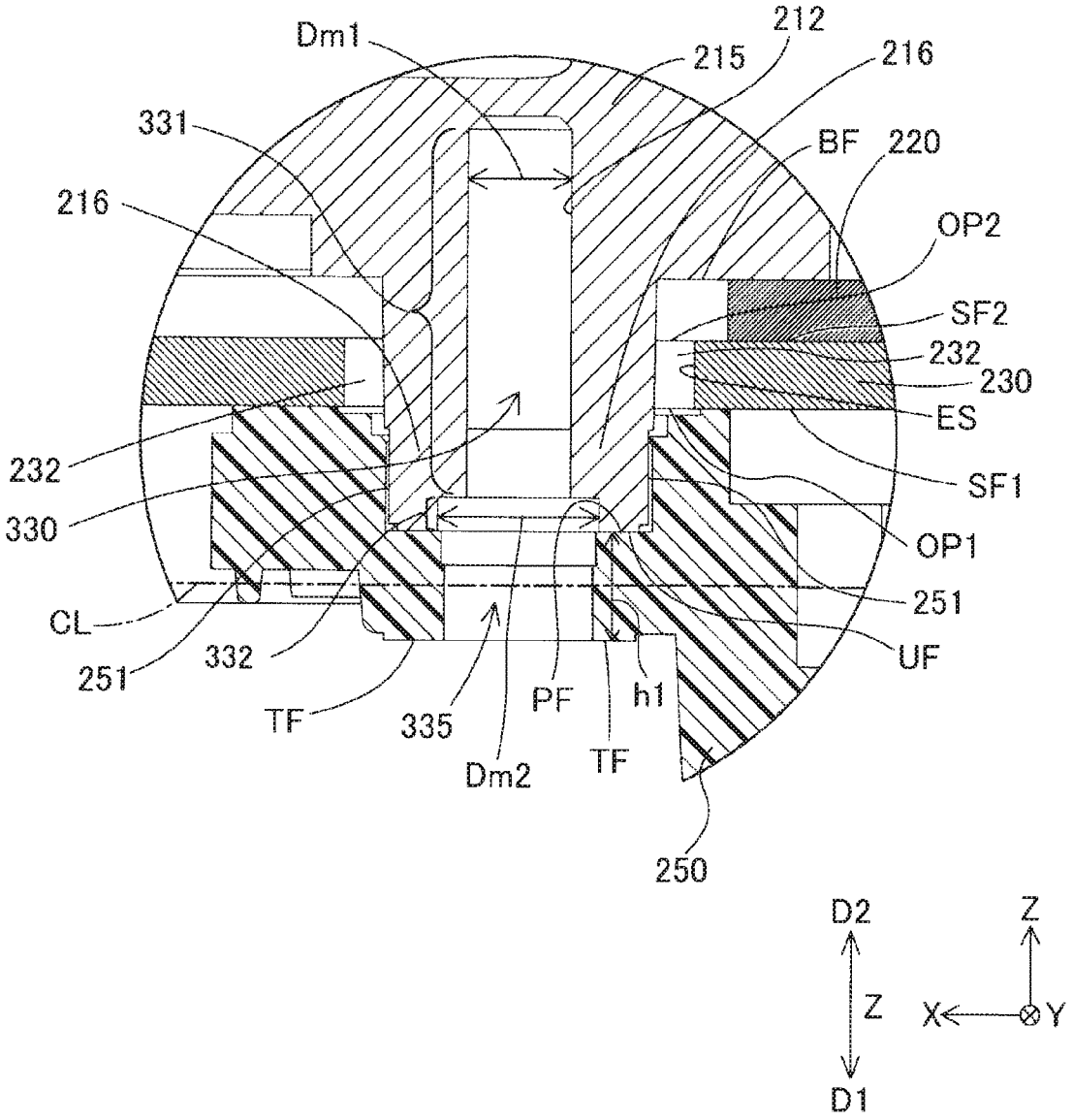
FIG. 16 is an enlarged view of a region XVI illustrated in FIG. 14.

The second through-hole 232 is a through-hole that penetrates the circuit substrate 230 in the Z direction. A protrusion portion 216 described later provided on the holder 210 is inserted into the second through-hole 232 (FIGS. 15 and 16).

The opening 233 is a through-hole that penetrates the circuit substrate 230 in the Z direction and is provided in parallel in the Y direction. A plurality of openings 233 are provided side by side in the X direction. The COF substrate 242 of the actuator unit 240 is inserted into the opening 233. A portion, which is a distal end portion of the COF substrate 242 on the second direction D2 side and protrudes from the opening 233 in the second direction D2, is bent in the −X direction or the +X direction to be coupled to the coupling terminal Ct.

The positioning through-holes Ph3 and Ph4 are through-holes that penetrate the circuit substrate 230 in the Z direction. The positioning through-holes Ph3 and Ph4 are disposed at positions overlapping with the positioning through-holes Ph1 and Ph2 of the first seal member 220, respectively, as viewed in the second direction D2. The positioning protrusion portions Pc1 and Pc2 of the case 250 described later are inserted into the positioning through-holes Ph3 and Ph4. The positioning protrusion portions Pc1 and Pc2 protrude in the second direction D2 from the surface of the circuit substrate 230 on the second direction D2 side.

The connectors Cn are provided on the surface of the circuit substrate 230 on the first direction D1 side at both end portions in the X direction. The flexible flat cable 113 which is an example of a "signal cable" is mounted on the connector Cn. The connector Cn is not limited to the flexible flat cable 113, and any other type of signal cable may be mounted.

On the surface of the circuit substrate 230 on the second direction D2 side, a second seal member SL2 and a third seal member SL3 are disposed at portions between outer edges of the circuit substrate 230 in the Y direction and the opening 233. The second seal member SL2 and the third seal member SL3 are substantially rectangular plate-like members that are elongated in the X direction. The second seal member SL2 and the third seal member SL3 are disposed at positions that do not overlap with the first seal member 220 when viewed in the second direction D2. In other words, the second seal member SL2 and the third seal member SL3 are provided between the circuit substrate 230 and the holder 210. The second seal member SL2 and the third seal member SL3 seal between the circuit substrate 230 and the holder 210. A film member, for example, a polyester film may be provided between the second seal member SL2, the third seal member SL3, and the circuit substrate 230. The detailed description of the placement positions of the second seal member SL2 and the third seal member SL3 will be described later.

The second seal member SL2 and the third seal member SL3 are bonding tapes for an acrylic foam structure, so-called double-sided tapes, and, for example, a product number Y-4825K-12 manufactured by 3M Japan Ltd., can be used. The second seal member SL2 and the third seal member SL3 are bonded to a bottom surface BF (FIG. 13) of the body portion 215 of the holder 210. A thickness (length in the Z direction) of the second seal member SL2 and the third seal member SL3 is preferably 0.7 mm or more. Further, a hardness of the second seal member SL2 and the third seal member SL3 is preferably lower than a hardness of the first seal member 220. For example, when the hardness of the second seal member SL2 and the third seal member SL3 is set to a rubber hardness of 20 or less, the hardness of the first seal member 220 may be set to a rubber hardness of about 47. The hardness of the second seal member SL2 and the third seal member SL3 may be the hardness of the first seal member 220 or more, and the thickness of the second seal member SL2 and the third seal member SL3 may be less than 0.7 mm. Further, as the second seal member SL2 and the third seal member SL3, a flexible member such as rubber or elastomer may be used instead of the double-sided tape. In this case, a flexible member may be disposed between the circuit substrate 230 and the holder 210, and the flexible member may be bonded and fixed to both members 230 and 210. Further, the third seal member SL3 may be omitted.

The actuator unit 240 includes the COF substrate 242, the fixing plate 241, and the piezoelectric body 243. The drive circuit for driving the piezoelectric body 243 is provided on the COF substrate 242. An end portion of the COF substrate 242 on the first direction D1 side is coupled to the piezoelectric body 243. An end portion of the COF substrate 242 on the second direction D2 side is inserted into the opening 233 of the circuit substrate 230 to be coupled to the coupling terminal Ct. The piezoelectric body 243 configures a piezoelectric element which is a passive element using a piezoelectric effect, and is driven according to a drive signal from the control section 110. The fixing plate 241 is fixed to a wall surface of the case 250 that defines an accommodation space 255 described later. The piezoelectric body 243 is fixed to a support plate 260*b* of the vibration plate 260 described later such that an end portion on the first direction D1 side is a free end, and is fixed to the end portion of the fixing plate 241 on the first direction D1 side such that an end portion on the second direction D2 side is a fixed end.

The case 250 is provided between the circuit substrate 230 and the vibration plate 260. The case 250 is formed of, for example, a synthetic resin such as polypropylene. The case 250 includes the accommodation space 255, the flow path pipe FP, and the positioning protrusion portions Pc1 and Pc2. The accommodation space 255 is provided in the Y direction, and is formed by a recess portion that opens in the second direction D2. The accommodation space 255 accommodates the COF substrate 242, the fixing plate 241, and the piezoelectric body 243. The flow path pipe FP is a cylindrical member that protrudes in the second direction D2. The flow path pipe FP communicates with the ink inlet 221 of the first seal member 220 and an ink inlet 261 described later provided in the vibration plate 260. That is, the flow path pipe FP functions as a flow path through which the ink supplied from the ink cartridge 117 flows into the ink inlet 261.

The positioning protrusion portions Pc1 and Pc2 are columnar members that protrude in the second direction D2. The surfaces of the positioning protrusion portions Pc1 and Pc2 on the second direction D2 side protrude in the second direction D2 more than the surface of the flow path pipe FP on the second direction D2 side. The positioning protrusion portion Pc1 is provided at a position overlapping with the positioning through-holes Ph1 and Ph3 when viewed in the first direction D1, is inserted into the positioning through-holes Ph1 and Ph3, and fits to the positioning through-holes Ph1 and Ph3. The positioning protrusion portion Pc2 is provided at a position overlapping with the positioning through-holes Ph2 and Ph4 when viewed in the first direction D1, is inserted into the positioning through-holes Ph2 and Ph4, and fits to the positioning through-holes Ph2 and Ph4. The positioning protrusion portions Pc1 and Pc2 function as positioning portions when the respective configuration members of the liquid ejecting head 200 are joined. Specifically, the positioning protrusion portions Pc1 and Pc2 are fit to the positioning through-holes Ph2 and Ph4, thereby determining the position of the circuit substrate 230 relative to the case 250 and the position of the first seal member 220 relative to the case 250.

Diameters of the positioning protrusion portions Pc1 and Pc2 are substantially equal to the lengths of the positioning through-holes Ph1, Ph2, Ph3, and Ph4 in the Y direction, and are also substantially equal to the lengths of the positioning through-holes Ph1 and Ph3 in the X direction. The length of the positioning through-holes Ph2 and Ph4 in the X direction is slightly larger than the length of the positioning through-holes Ph1 and Ph3 in the X direction. Therefore, when the positioning protrusion portion Pc1 is inserted into the positioning through-holes Ph1 and Ph3, there is almost no play between the positioning through-holes Ph1 and Ph3, and the positioning protrusion portion Pc1 in the X direction and the Y direction. On the other hand, when the positioning protrusion portion Pc2 is inserted into the positioning through-holes Ph2 and Ph4, play exists between the positioning through-holes Ph2 and Ph4, and the positioning protrusion portion Pc2 in the X direction. Therefore, it is possible to position the case 250 and the first seal member 220 while absorbing an error between an interval between the positioning protrusion portions Pc1 and Pc2, and an interval between the positioning through-holes Ph1 and Ph2. In addition, it is possible to position the case 250 and the circuit substrate 230 while absorbing an error between an interval between the positioning protrusion portions Pc1 and Pc2, and an interval between the positioning through-holes Ph3 and Ph4.

As illustrated in FIG. 4, the vibration plate 260 is a substantially rectangular plate-like member that is elongated in the X direction. The vibration plate 260 is provided between the case 250 and the flow path forming member 270. The vibration plate 260 functions as a wall surface that closes a surface of the flow path forming member 270 on the second direction D2 side. The vibration plate 260 is elastically deformed by the piezoelectric body 243. Accordingly, ink is ejected from a pressure chamber 275 described later via the nozzle 282. The vibration plate 260 is formed, for example, by stacking an elastic film 260*a* made of an elastic member such as a resin film and a support plate 260*b* made of a metal material such as stainless steel (SUS) for supporting the elastic film 260*a* (FIG. 6). The elastic film 260*a* is supported by being joined to a surface of the support plate 260*b* on the −Z direction side. The vibration plate 260 includes the ink inlet 261. The ink inlet 261 is a through-hole that penetrates the vibration plate 260 in the Z direction. The ink inlet 261 communicates with the flow path pipe FP and a third flow path 273 described later provided in the flow path forming member 270, and allows the ink supplied from the ink cartridge 117 to flow into the third flow path 273.

The flow path forming member 270 is a plate-like member having an outer shape that matches an outer shape of the vibration plate 260. The flow path forming member 270 is provided between the case 250 and the nozzle plate 280. The flow path forming member 270 includes the third flow path 273. Although not illustrated in FIG. 4, the flow path forming member 270 includes the pressure chamber 275. A detailed description of the third flow path 273 and the pressure chamber 275 will be described later. In the present embodiment, the flow path forming member 270 is formed of, for example, silicon (Si). The flow path forming member 270 may have a configuration in which a plurality of substrates are stacked.

Figure 7:
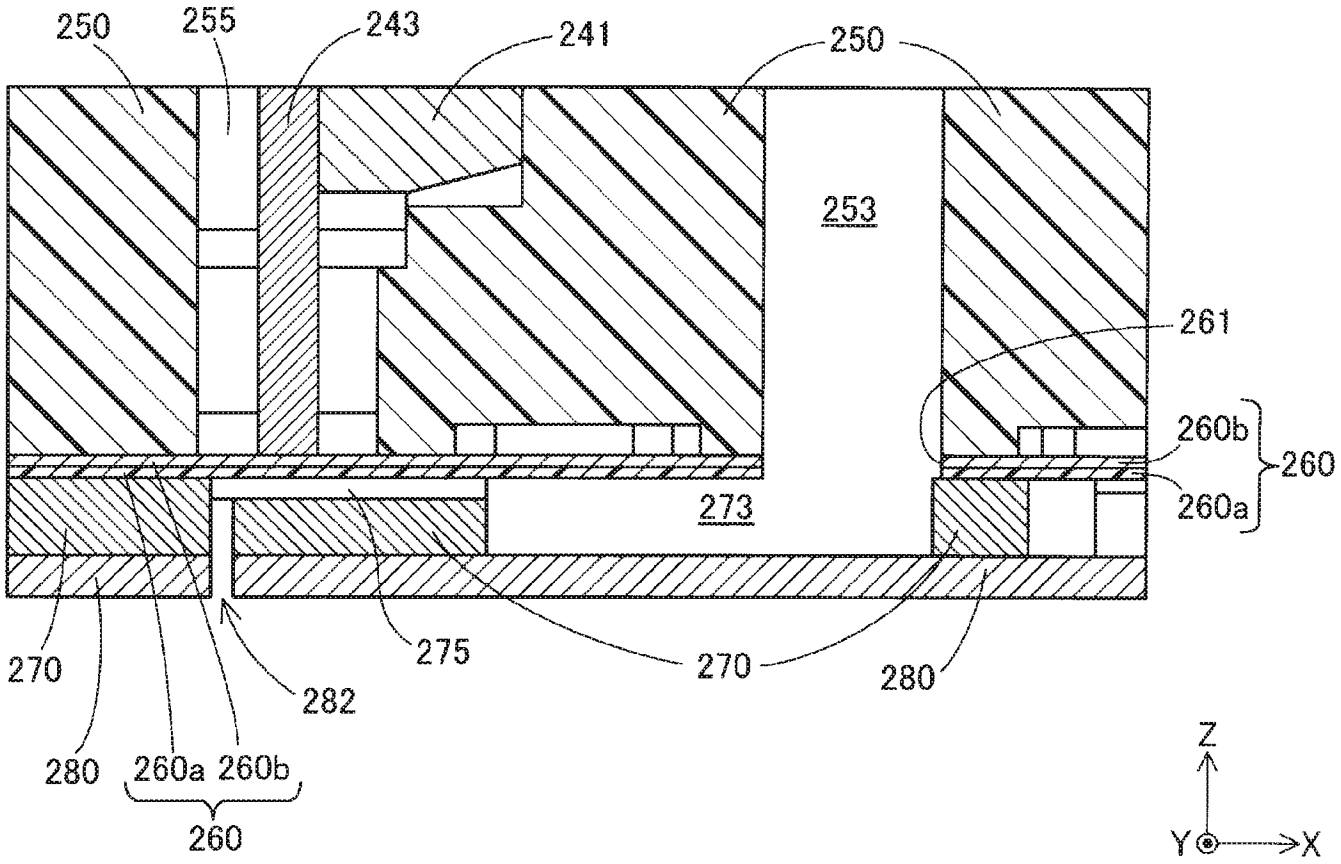
FIG. 7 is an enlarged view of a region VII illustrated in FIG. 6.

The nozzle plate 280 is a thin plate-like member having an outer shape that matches the outer shapes of the vibration plate 260 and the flow path forming member 270. The nozzle plate 280 is provided in the flow path forming member 270 on the first direction D1 side. The nozzle plate 280 includes a plurality of nozzle rows 281 including a plurality of nozzles 282 disposed side by side in the Y direction. The nozzle 282 is a through-hole that penetrates the nozzle plate 280 in the Z direction, and is a through-hole for ejecting ink onto the print medium P. The plurality of nozzle rows 281 are disposed side by side in the X direction. Each nozzle row 281 is provided at a position corresponding to the pressure chamber 275 (FIG. 7) described later in the flow path forming member 270. The nozzle plate 280 functions as a wall surface that closes the surface of the flow path forming member 270 in the first direction D1 at a portion where the nozzle 282 is not provided (FIG. 7). The nozzle plate 280 is formed of, for example, stainless steel (SUS), silicon (Si), or the like.

The case 250, the vibration plate 260, the flow path forming member 270, and the nozzle plate 280 described above are respectively fixed by an adhesive. Specifically, the surface of the nozzle plate 280 on the second direction D2 side and the surface of the flow path forming member 270 on the first direction D1 are bonded with an adhesive. Further, the surface of the flow path forming member 270 on the second direction D2 side and the surface of the vibration plate 260 on the first direction D1 side are bonded with an adhesive. The surface of the vibration plate 260 on the second direction D2 side and the surface of the case 250 on the first direction D1 side are bonded with an adhesive. The adhesive may be applied to each of the configuration members 250, 260, 270 and 280.

The cover 290 is a frame that accommodates the vibration plate 260, the flow path forming member 270, and the nozzle plate 280. The cover 290 is provided with an opening that exposes the surface of the nozzle plate 280 on the first direction D1 side when the vibration plate 260, the flow path forming member 270, and the nozzle plate 280 are accommodated in the cover 290. The cover 290 is provided with four through-holes 291 into which the screws 293, 294, 295, and 296 are inserted. The cover 290 is fixed to the holder 210 by the screws 293, 294, 295, and 296, with the case 250 and the circuit substrate 230 interposed therebetween.

The respective configuration members of the liquid ejecting head 200 described above are stacked and fastened by the four screws 293, 294, 295, and 296. The four screws 293, 294, 295, and 296 are constituted by, for example, full screws. In the present embodiment, the "full screw" means a screw of which a side surface is screw-cutting except for a head of the screw. As will be described in detail later, the screws 293, 294, 295, and 296 are inserted into the screw holes 330 formed in the case 250 in advance, and are screwed to form screw grooves in the body portion 215 of the holder 210. Then, the holder 210, the case 250, and the cover 290 are fastened. Specifically, seating surfaces of the screws 293, 294, 295, and 296 that receive a load due to the fastening abut against circumferences of the through-holes 291 of the cover 290, and sandwich the case 250 between the cover 290 and the holder 210. Therefore, the holder 210, the case 250, and the cover 290 are fixed.

Figure 5:
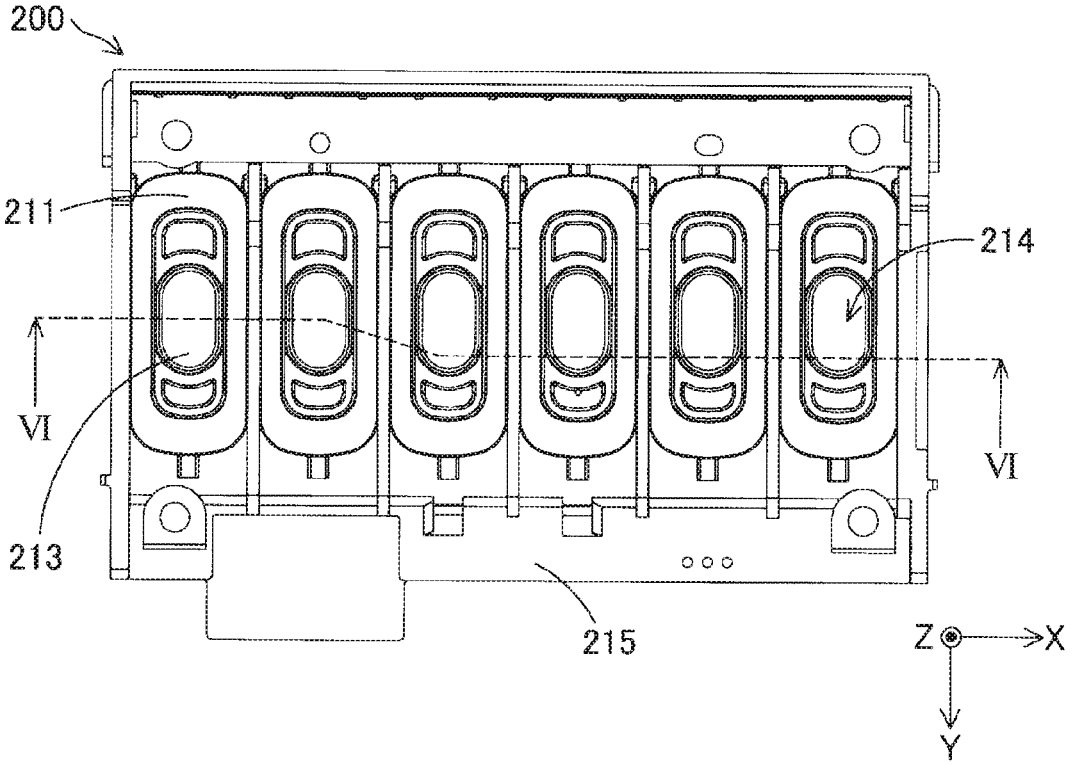
FIG. 5 is a top view of the liquid ejecting head.

A3. Configuration of Flow Path:

FIG. 5 is a top view of the liquid ejecting head 200 in a state where the respective members constituting the liquid ejecting head 200 are stacked and fastened. FIG. 6 is a sectional view of the liquid ejecting head 200, which is taken along line VI-VI in FIG. 5. FIG. 7 is an enlarged view of a region VII illustrated in FIG. 6.

As illustrated in FIG. 6, the second flow path 219 (flow path 219*a*, flow path 219*b*, and flow path 219*c*) formed in the holder 210 communicates with the first flow path 253 formed in the case 250. As illustrated in FIG. 7, the first flow path 253 communicates with the third flow path 273 of the flow path forming member 270. The flow path forming member 270 defines the pressure chamber 275 of the third flow path 273 on the −X direction side. The pressure chamber 275 is configured such that a recess portion formed in the flow path forming member 270 is sealed by the elastic film 260*a* on the second direction D2 side when viewed in the second direction D2. That is, the surface of the pressure chamber 275 on the second direction D2 side is formed of the elastic film 260*a*, and changes a volume in the pressure chamber 275 by being displaced in accordance with a displacement of the piezoelectric body 243. Although not illustrated, the pressure chambers 275 are provided side by side in the Y direction corresponding to the nozzle rows 281. The pressure chamber 275 communicates with the third flow path 273 and the nozzle 282, and the ink flowed into the pressure chamber 275 from the third flow path 273 is ejected from the nozzle 282 by changing the volume in the pressure chamber 275. Therefore, the second flow path 219, the first flow path 253, and the third flow path 273 are coupled to one nozzle 282 via the pressure chamber 275.

Figure 8:
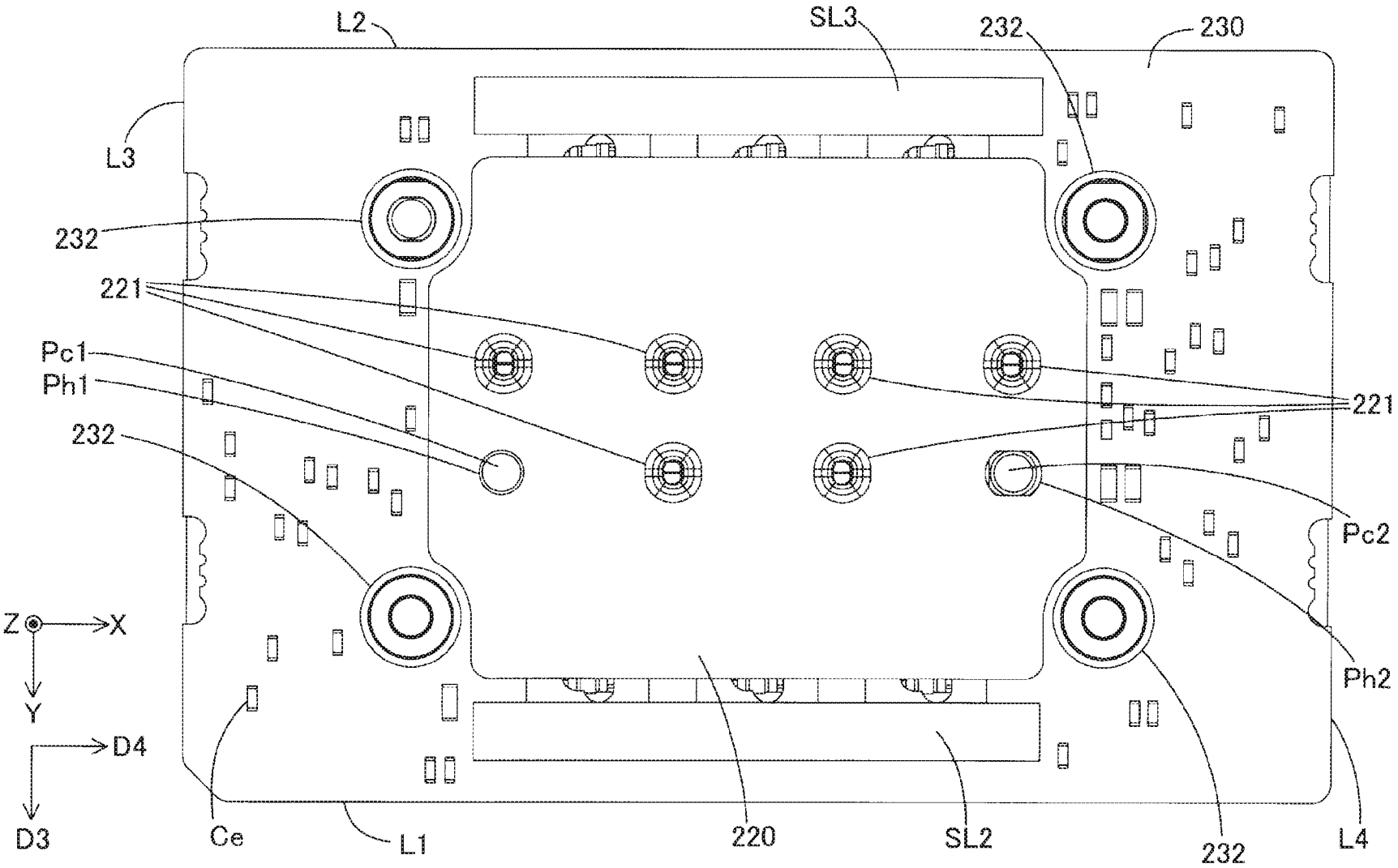
FIG. 8 is a plan view of the liquid ejecting head which is viewed from above in a second direction.
Figure 9:
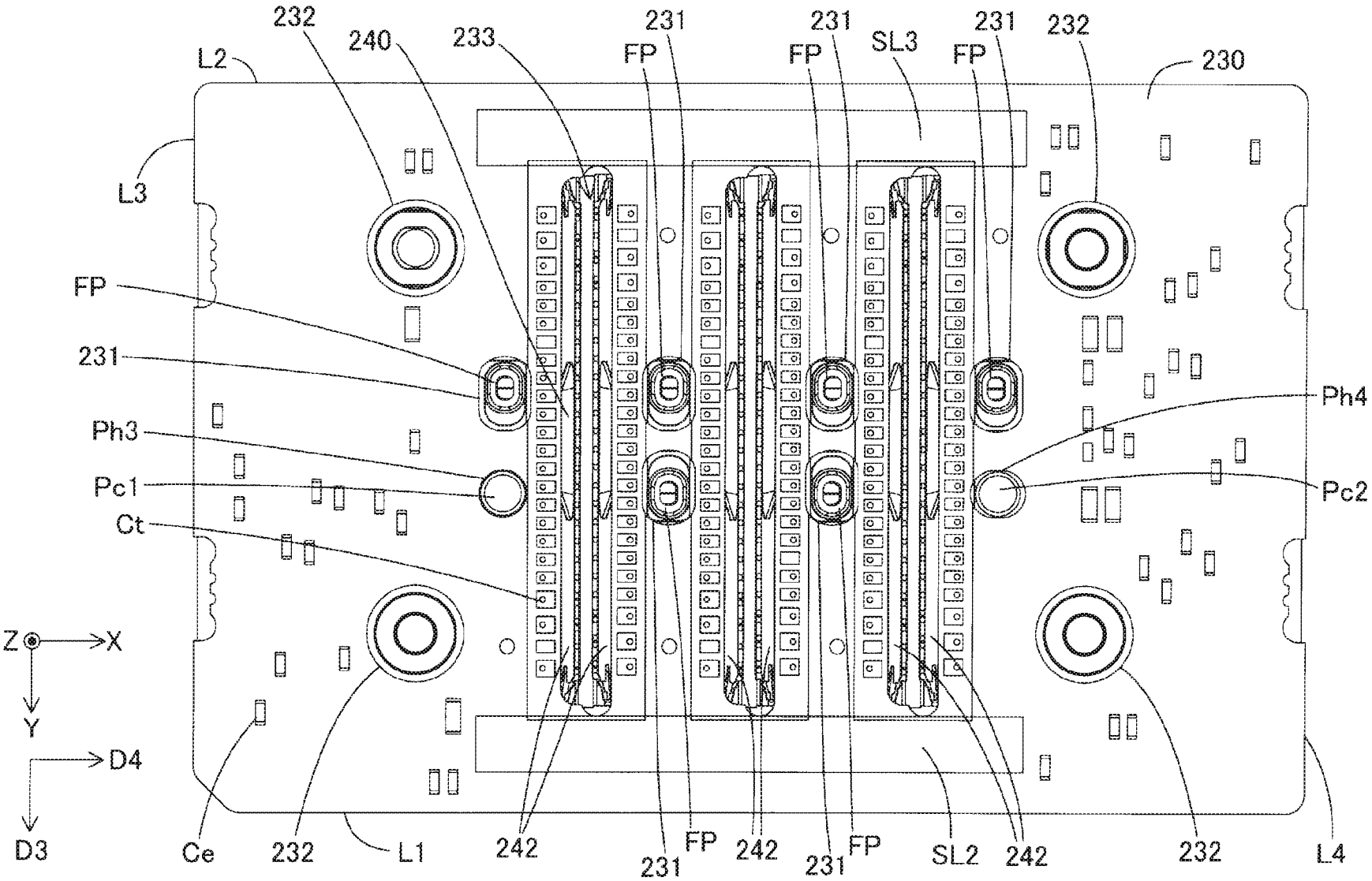
FIG. 9 is a plan view of the liquid ejecting head which is viewed from above in the second direction without a holder and a first seal member.

A4. Placement Positions of Second Seal Member and Third Seal Member:

FIG. 8 is a plan view of the liquid ejecting head 200 viewed from above in the second direction D2, in which the holder 210 is removed, in a state where the respective members constituting the liquid ejecting head 200 are joined. FIG. 9 is a plan view of the liquid ejecting head 200 viewed from above in the second direction D2, in which the holder 210 and the first seal member 220 are removed, in a state where the respective members constituting the liquid ejecting head 200 are joined. As illustrated in FIGS. 8 and 9, the circuit substrate 230 includes a first side L1 and a second side L2 parallel to the fourth direction D4, and a third side L3 and a fourth side L4 parallel to the third direction D3. The first side L1 and the second side L2 correspond to long sides of the circuit substrate 230, and the third side L3 and the fourth side L4 correspond to short sides of the circuit substrate 230. The first side L1 and the second side L2 face each other in the third direction D3, and the third side L3 and the fourth side L4 face each other in the fourth direction D4.

As illustrated in FIG. 8, the second seal member SL2 is disposed at an end portion on a side of the first side L1 at a central portion of the circuit substrate 230 in the fourth direction D4. The third seal member SL3 is disposed at an end portion on a side of the second side L2 at the central portion of the circuit substrate 230 in the fourth direction D4. As illustrated in FIG. 9, the second seal member SL2 is disposed between the first side L1 and the opening 233. The third seal member SL3 is disposed between the second side L2 and the opening 233. In addition, a part of the second seal member SL2 may overlap with the opening 233 in plan view in the second direction D2, and a part of the third seal member SL3 may overlap with the opening 233 in plan view in the second direction D2. As illustrated in FIGS. 8 and 9, the second seal member SL2 and the third seal member SL3 are disposed at positions not overlapping with the first seal member 220, the plurality of circuit elements Ce, the flow path pipe FP, and the positioning protrusion portions Pc1 and Pc2. Further, the second seal member SL2 and the third seal member SL3 are disposed at positions not overlapping with the plurality of nozzles 282. That is, the second seal member SL2 and the third seal member SL3 do not overlap with the nozzle row 281.

Figure 10:
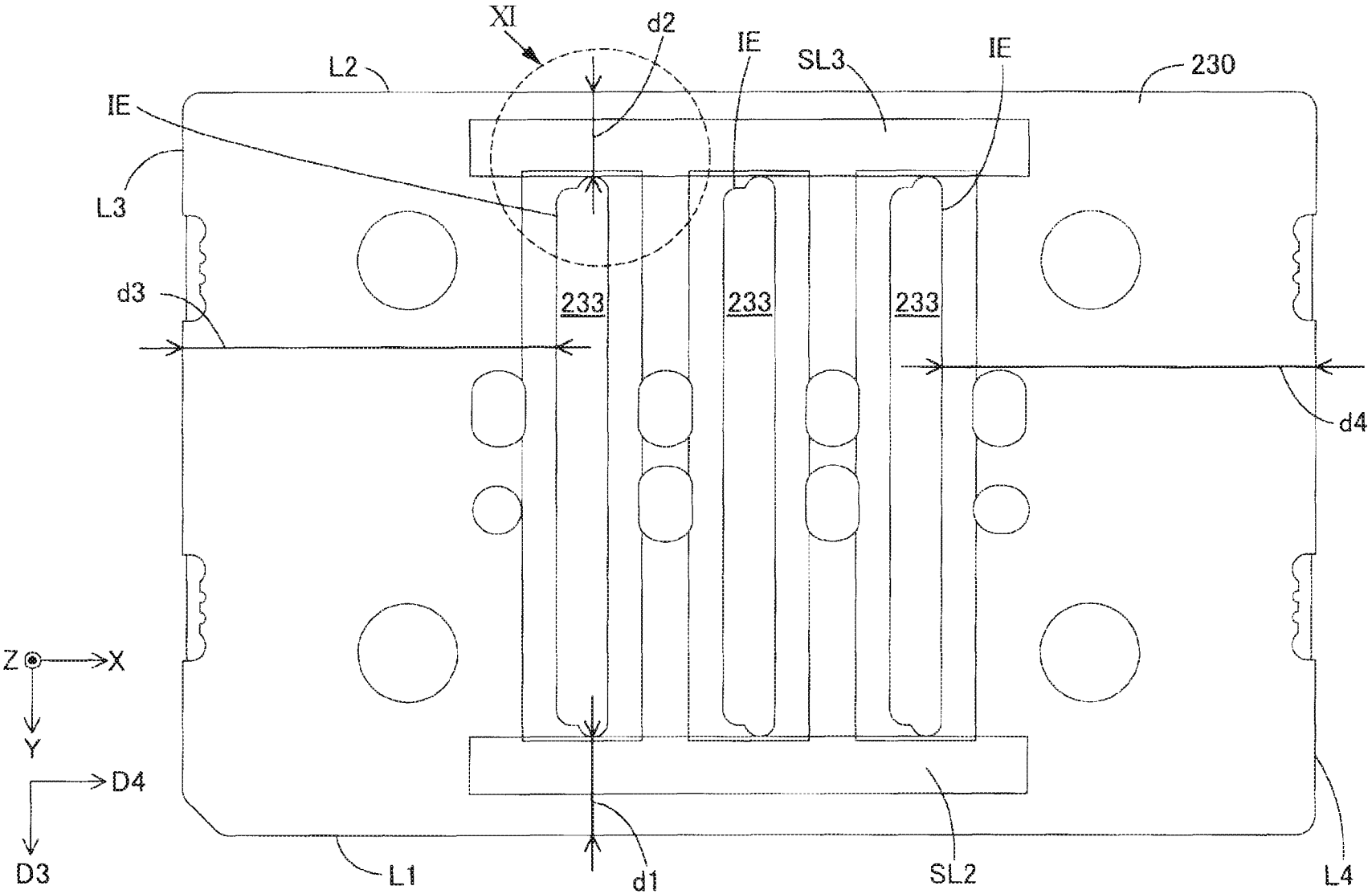
FIG. 10 is an explanatory view for explaining a positional relationship between a second seal member, a third seal member, and an opening.
Figure 11:
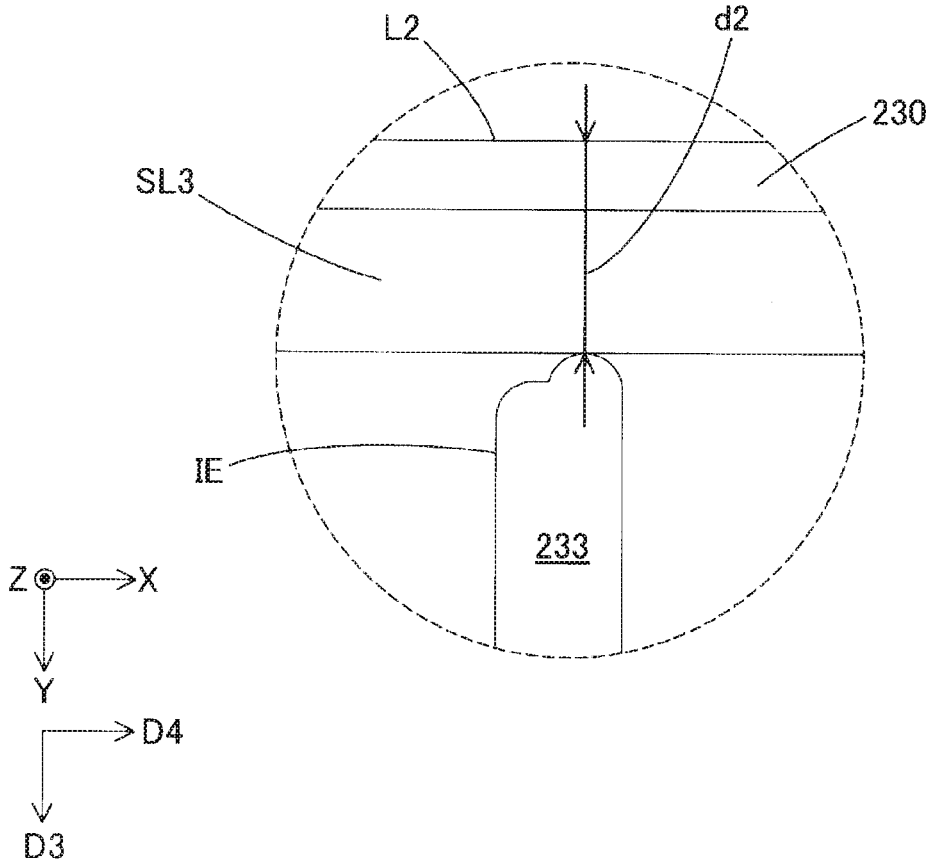
FIG. 11 is an enlarged view of a region XI illustrated in FIG. 10.

FIG. 10 is an explanatory view for explaining a positional relationship between the second seal member SL2, the third seal member SL3, and the opening 233. FIG. 11 is an enlarged view of a region XI illustrated in FIG. 10. In FIG. 11, some configuration elements in the circuit substrate 230 are not illustrated for easy understanding. As illustrated in FIG. 10, a distance d1 between the first side L1 and the opening 233 is shorter than a distance d3 between the third side L3 and the opening 233, and a distance d4 between the fourth side L4 and the opening 233. A distance d2 between the second side L2 and the opening 233 is shorter than the distance d3 and the distance d4.

In the present embodiment, "the distances d1, d2, d3, and d4 between the opening 233 and the respective sides L1, L2, L3, and L4" are distances from an inner edge IE of opening 233 to the respective sides L1, L2, L3, and L4. As illustrated in FIG. 11, the opening 233 is defined by the inner edge IE. The distance d2 is a distance from the second side L2 to the inner edge IE, and although not illustrated, the same applies to the distances d1, d3, and d4.

Figure 12:
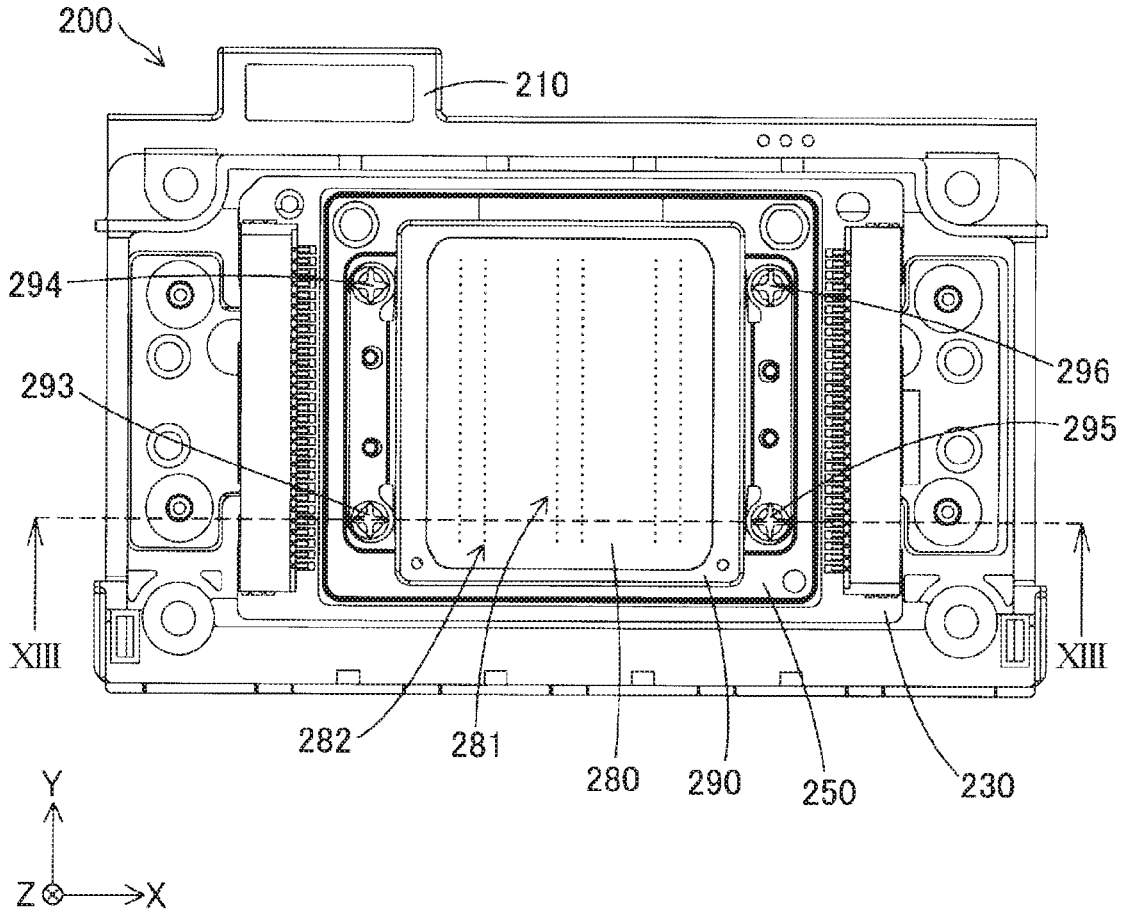
FIG. 12 is a bottom view of the liquid ejecting head.
Figure 13:
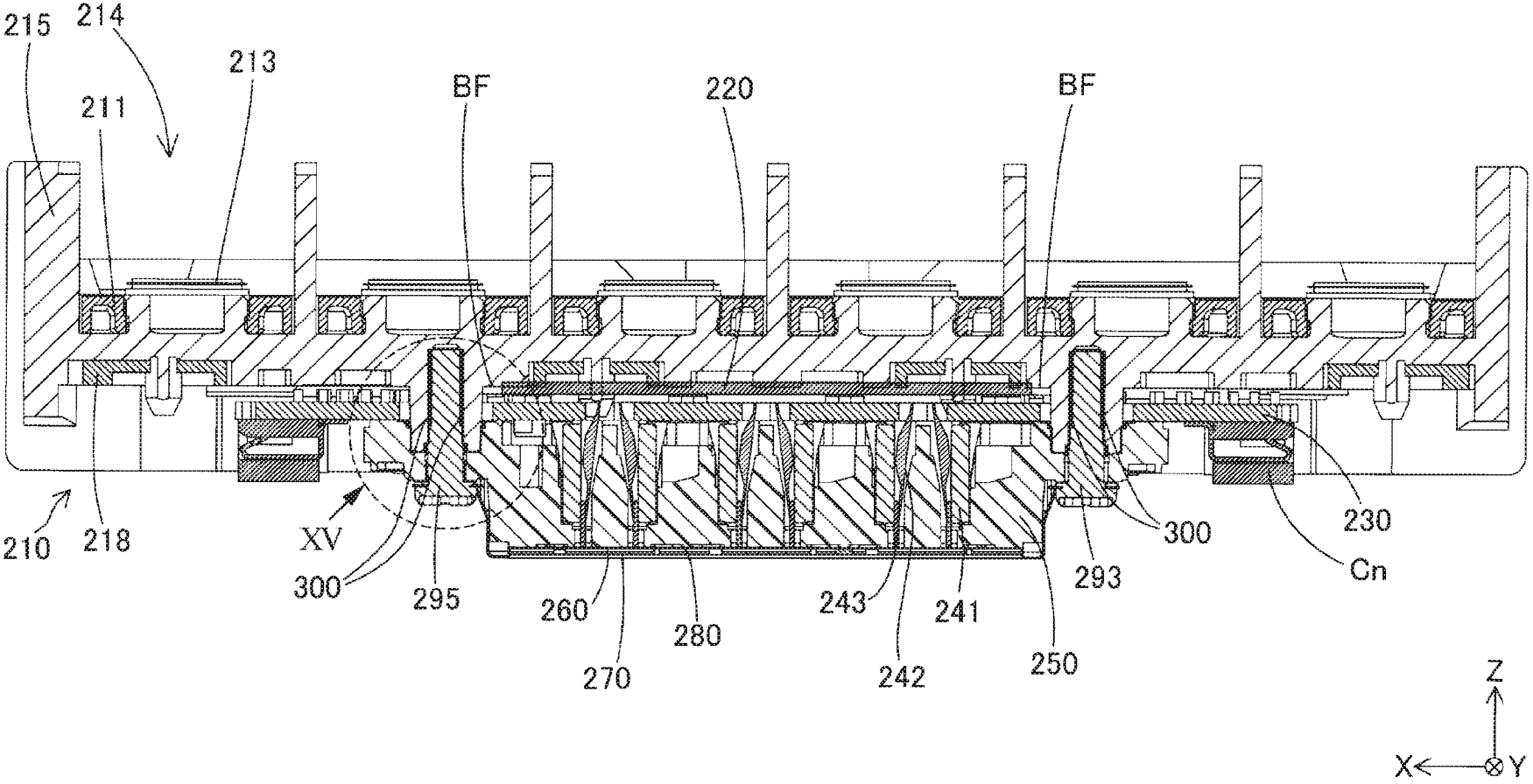
FIG. 13 is a sectional view of the liquid ejecting head which is taken along line XIII-XIII in FIG. 12.
Figure 14:
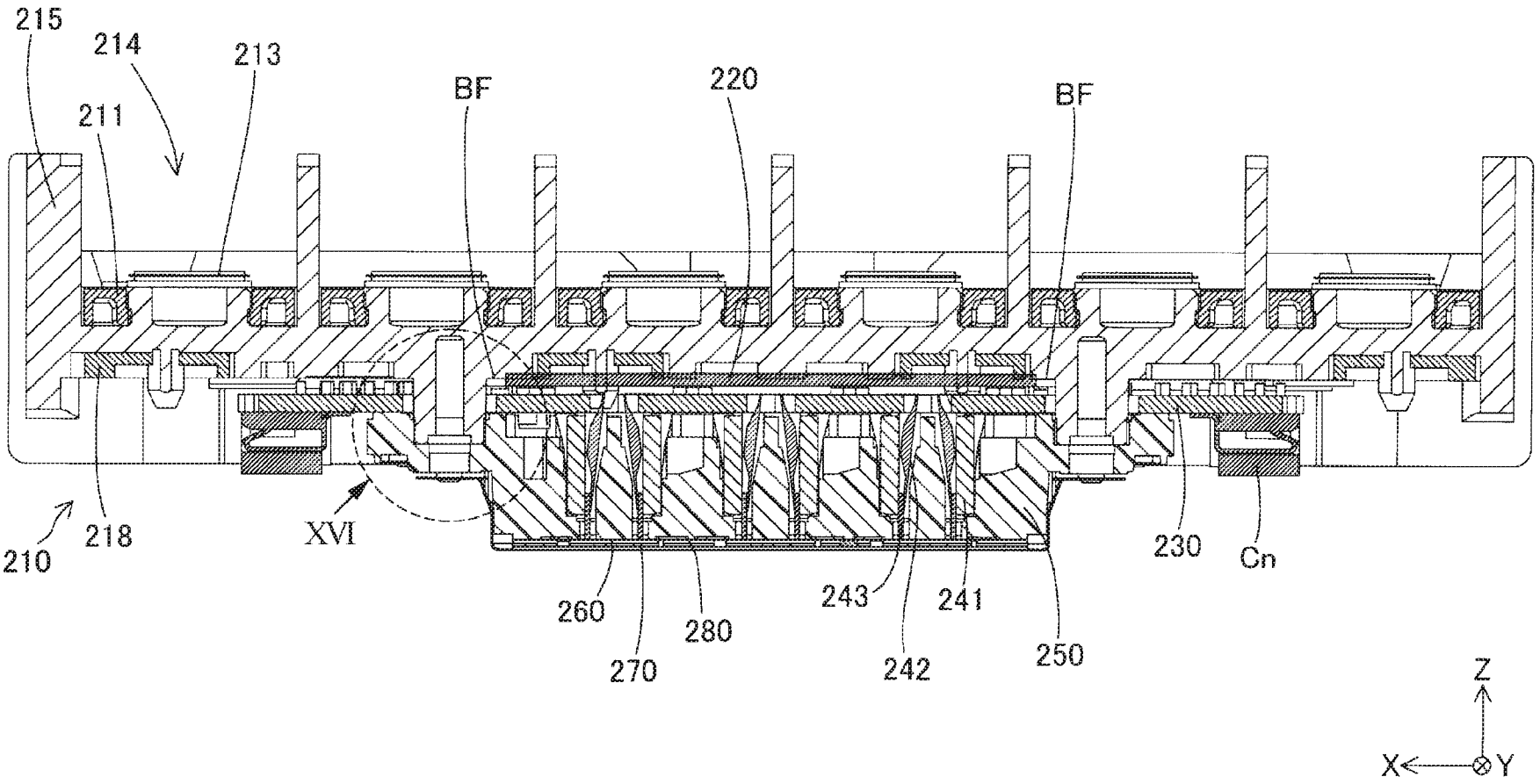
FIG. 14 is a sectional view of the liquid ejecting head, which is taken along line XIII-XIII in a state where screws are removed.

A5. Placement Position of Adhesive:

FIG. 12 is a bottom view of the liquid ejecting head 200. FIG. 13 is a sectional view of the liquid ejecting head 200, which is taken along line XIII-XIII in FIG. 12. FIG. 14 is a sectional view of the liquid ejecting head 200, which is taken along line XIII-XIII, in a state where the screw 293 and the screw 295 are removed from the liquid ejecting head 200 illustrated in FIG. 12. FIG. 15 is an enlarged view of a region XV illustrated in FIG. 13. FIG. 16 is an enlarged view of a region XVI illustrated in FIG. 14.

As illustrated in FIG. 12, the body portion 215 of the holder 210, the case 250, and the cover 290 are fastened by the screws 293, 294, and 295, and the screw 296. As illustrated in FIG. 13, an adhesive 300 is disposed on outer peripheral surfaces of the screws 295 and 293, and a joint surface between the body portion 215 of the holder 210 and the case 250. The adhesive 300 bonds the body portion 215 of the holder 210 and the case 250. The adhesive 300 is an epoxy-based adhesive, and for example, an Able Bond 342-37 manufactured by Henkel Able Stick Japan Co., Ltd, can be used. The adhesive 300 may use a product number C1235 manufactured by TISC Co., ltd.

Prior to the description of the placement position of the adhesive 300, a configuration near a fastening portion of the screw 295 will be described with reference to FIG. 16. The body portion 215 of the holder 210 includes a cylindrical protrusion portion 216 protruding in the first direction D1 from the bottom surface BF of the body portion 215 and a recess portion 212 recessing in the second direction D2 from the bottom surface BF of the body portion 215. An inside of the protrusion portion 216 is a through-hole penetrating in the Z direction, and forms a part of the screw hole 330. In other words, the protrusion portion 216 has a part of the screw hole 330. The recess portion 212 is continuous to the through-hole provided in the protrusion portion 216 and forms a part of the screw hole 330. In other words, the recess portion 212 has a part of the screw hole 330. When the holder 210, the case 250, and the cover 290 are fastened to each other, the screw 295 enters the screw hole 330 on the second direction D2 inside, so that an inner peripheral surface of the screw hole 330 is cut to form a screw groove. The screw hole 330 has a first portion 331 and a second portion 332.

The first portion 331 is located in the screw hole 330 on the second direction D2 side. The first portion 331 is a portion where the screw groove is formed. The first portion 331 continuously abuts against the screw 295 to fix the screw 295. The second portion 332 is a portion located closer to the first direction D1 side than the first portion 331, and near the opening of the screw hole 330. A diameter Dm1 of the first portion 331 is smaller than a diameter Dm2 of the second portion 332. The second portion 332 functions as a space for releasing shavings, which are discharged when the screw groove is formed in the screw hole 330, of the inner peripheral surface of the first portion 331 of the screw hole 330. Therefore, the second portion 332 does not abut against the screw 295, and the fastening portion of the screw 295 is not formed in the second portion 332.

The case 250 has a recess portion 251 fit to the protrusion portion 216 of the holder 210 and a through-hole 335 into which the screw 295 is inserted. The recess portion 251 is a recess portion that is recessed in the first direction D1 from the surface of the case 250 on the second direction D2 side. The recess portion 251 has a bottom surface UF against which a distal end surface PF of the protrusion portion 216 on the first direction D1 side abuts. The through-hole 335 penetrates from the bottom surface UF of the recess portion 251 to a surface TF of the case 250 on the first direction D1 side in the Z direction. The screw 295 is inserted into the protrusion portion 216 via the through-hole 335. Although the diameter of the through-hole 335 is smaller than the diameter of the recess portion 251, it is larger than a diameter Dm1 of the first portion 331 of the screw hole 330. Therefore, no screw groove is formed in the through-hole 335.

The adhesive 300 is applied to the distal end surface PF of the protrusion portion 216 of the holder 210 when the respective configuration members of the liquid ejecting head 200 are fastened. The adhesive 300 adheres circumferences of the screws 293, 294, and 295, and the screw 296 when the screws 293, 294, and 295, and the screw 296 are inserted into the screw holes 330 and is tightened. Therefore, in a state where the respective configuration members of the liquid ejecting head 200 are fastened by the screws 293, 294, and 295, and the screw 296 entering the screw holes 330 on the second direction D2 side, the adhesive 300 can exist surroundings of the screws 293, 294, and 295, and the screw 296, and between surfaces of the body portion 215 and the case 250 facing each other. In the following description, for convenience of description, description will be provided by giving a name and a reference numeral to each portion (position) where the adhesive 300 is disposed.

As illustrated in FIG. 15, the adhesive 300 includes a first adhesive 301, a second adhesive 302, a third adhesive 303, a fourth adhesive 304, a fifth adhesive 305, a sixth adhesive 306, and a seventh adhesive 307. The adhesive 300 is configured by continuously disposing the adhesives 301, 302, 303, 304, 305, 306, and 307. In FIG. 15, the adhesive 300 is line-symmetric with respect to a line which passes through the central portion of the screw 295 in the X direction and is parallel to the Z direction. Reference numerals of configurations on the +X direction side of the parallel line are omitted.

As illustrated in FIGS. 15 and 16, the first adhesive 301 is disposed between the protrusion portion 216 and the screw 295, and between the recess portion 212 and the screw 295 in the first portion 331. The second adhesive 302 is disposed on the surface of the case 250 on the second direction D2 side, which is opposed to the second through-hole 232. In other words, the second adhesive 302 is disposed on the surface of the case 250 on the second direction D2 side, and the surface overlapping with the second through-hole 232 in plan view in the second direction D2. The third adhesive 303 and the fourth adhesive 304 are disposed between the protrusion portion 216 and the recess portion 251 in the X direction. In other words, the third adhesive 303 and the fourth adhesive 304 are disposed between the outer peripheral surface of the protrusion portion 216 and the inner peripheral surface of the recess portion 251. The fifth adhesive 305 is disposed between the protrusion portion 216 and the screw 295 in the second portion 332. The sixth adhesive 306 is disposed between the distal end surface PF of the protrusion portion 216 and the bottom surface UF of the recess portion 251. The seventh adhesive 307 is disposed between the through-hole 335 and the screw 295.

As illustrated in a circle of a broken line in FIG. 15, the adhesive 300 (more precisely, the third adhesive 303) does not adhere to the surface SF1 of the circuit substrate 230 on the first direction D1 side. Further, the third adhesive 303 is disposed closer than the end surface ES defining the second through-hole 232 of the circuit substrate 230 in the X direction and is not disposed farther than the end surface ES, with reference to the outer peripheral surface of the protrusion portion 216. The adhesive 300 (more precisely, the seventh adhesive 307) is disposed closer to the second direction D2 side than a half position of the length of the through-hole 335 in the Z direction indicated by a one-dotted chain line CL and, it is preferable that the seventh adhesive 307 be not disposed on the first direction D1 side of such a position.

According to the liquid ejecting head 200 of the first embodiment described above, the liquid ejecting head 200 includes the case 250, the circuit substrate 230 provided in the second direction D2 with respect to the case 250, the first seal member 220 provided in the second direction D2 with respect to the circuit substrate 230, the holder 210 provided in the second direction D2 with respect to the first seal member 220, the screws 293, 294, 295, and 296 fixing the holder 210 and the case 250, and the adhesive 300 fixing the holder 210, the case 250, and the cover 290. Therefore, even if fastening forces of the screws 293, 294, 295, and 296 are reduced, it is possible to suppress a decrease in the sealing performance between the holder 210 and the case 250.

The holder 210 has the protrusion portion 216, the case 250 has the recess portion 251 to be fit to the protrusion portion 216, and the adhesives 302, 303, 304, 305, and 306 are provided between the protrusion portion 216 and the recess portion 251. Therefore, it is possible to suppress leakage of the adhesive 300 to the outside.

Further, the adhesive 307 is formed in the case 250 and provided between the through-holes 335 penetrating the bottom surface UF of the recess portion 251, and the screws 293, 294, 295, and 296. Therefore, it is possible to suppress a decrease in the fastening forces of the screws 293, 294, 295, and 296.

The screw hole 330 has the first portion 331 and the second portion 332, the diameter Dm1 of the first portion 331 is smaller than the diameter Dm2 of the second portion 332, and the adhesive 301 is provided between the screws 293, 294, 295, and 296 and the first portion 331. Therefore, the adhesive 300 can adhere to the screw groove portion formed in the screw hole 330 corresponding to the inside of the protrusion portion 216 on the second direction D2 side, and a decreased in the fastening forces of the screws 293, 294, 295, and 296 can be reduced.

Further, the adhesive 302 does not adhere to the surface of the circuit substrate 230 on the first direction D1 side, that is, the surface on the side where the flow path forming member 270 is disposed. Therefore, an occurrence of electrical failure due to the adhesion of the adhesive 300 to the surface of the circuit substrate 230 on the first direction D1 side can be suppressed.

The circuit substrate 230 is provided with the opening 233 for inserting the COF substrate 242, and the second seal member SL2 is provided between the circuit substrate 230 and the holder 210 at a portion between the outer edge of the circuit substrate 230 and the opening 233. Therefore, it is possible to suppress the intrusion of ink mist into a piezo and an electrode portion inside the liquid ejecting head 200 via the opening 233 from between the circuit substrate 230 and the holder 210. As a result, it is possible to suppress the occurrence of the electrical failure of the liquid ejecting head 200.

The distance d1 between the opening 233 and the first side L1 in the third direction D3, and the distance d2 between the opening 233 and the second side L2 in the third direction D3 are shorter than the distance d3 between the opening 233 and the third side L3 in the fourth direction D4, and the distance d4 between the opening 233 and the fourth side L4 in the fourth direction D4. The second seal member SL2 is provided between the first side L1 and the opening 233 in the third direction D3. Therefore, the distance between the opening 233 and the outer edge of the circuit substrate 230 can be made further short, and the second seal member SL2 can be provided at a location where ink mist can easily enter. Therefore, the entry of ink mist into the opening 233 of the circuit substrate 230 can be further suppressed.

Further, the second seal member SL2 does not overlap with the plurality of nozzles 282 in plan view in the second direction D2. Therefore, it is possible to reduce a reaction force of the second seal member SL2 to the nozzle surface, which is generated by disposing the second seal member SL2 between the circuit substrate 230 and the holder 210. Therefore, it is possible to suppress an occurrence of deviation in the nozzle surface due to the reaction force of the second seal member SL2.

Further, since the third seal member SL3 is provided between the second side L2 and the opening 233 in the third direction D3, it is possible to further suppress the entry of the ink mist into the opening 233 of the circuit substrate 230.

Further, since the second seal member SL2 does not overlap with the flow path pipe FP in plan view in the second direction D2, it is possible to suppress the generation of a gap between the circuit substrate 230 and the second seal member SL2. Therefore, it is possible to further suppress the entry of the ink mist into the opening 233 of the circuit substrate 230.

In addition, since the second seal member SL2 does not overlap with the protrusion portion 216 in plan view in the second direction D2, it is possible to suppress the generation of a gap between the holder 210 and the second seal member SL2. Therefore, it is possible to further suppress the entry of the ink mist into the opening 233 of the circuit substrate 230.

Further, since the second seal member SL2 does not overlap with the first seal member 220 in plan view in the second direction D2, it is possible to suppress the generation of a gap between the circuit substrate 230 and the second seal member SL2. Therefore, it is possible to further suppress the entry of the ink mist into the opening 233 of the circuit substrate 230.

Further, the circuit element Ce is provided on the surface of the circuit substrate 230 in the second direction D2, and the second seal member SL2 does not overlap with the circuit element Ce in plan view in the second direction D2. Therefore, it is possible to suppress the generation of a gap between the circuit substrate 230 and the second seal member SL2. Therefore, it is possible to further suppress the entry of the ink mist into the opening 233 of the circuit substrate 230.

Further, since the hardness of the second seal member SL2 is lower than the hardness of the first seal member 220, it is possible to reduce the reaction force of the second seal member SL2, which is generated by disposing the second seal member SL2 between the circuit substrate 230 and the holder 210. As a result, it is possible to suppress the occurrence of the deviation in the nozzle surface due to the reaction force of the second seal member SL2.

Further, since the thickness of the second seal member SL2 is 0.7 mm or more, it is possible to further suppress the entry of the ink mist into the opening 233 of the circuit substrate 230. Further, the reaction force of the second seal member SL2 generated by disposing the second seal member SL2 between the circuit substrate 230 and the holder 210 can be reduced. Therefore, it is possible to suppress the occurrence of the deviation in the nozzle surface due to the reaction force of the second seal member SL2.

Further, since the second seal member SL2 is the double-sided tape, the adhesive strength between the circuit substrate 230 and the holder 210 can be improved.

The direction in which the screws 293, 294, 295, and 296 are advanced by tightening the screws 293, 294, 295, and 296 is the second direction D2 opposite to the direction of gravity. Therefore, due to the configuration of the liquid ejecting head 200, even if the screws 293, 294, 295, and 296 have to be tightened in the direction opposite to the direction of gravity, where the screws are easily released, it is possible suppress that fixing of the case 250 and the holder 210 is released by fixing the case 250 and the holder 210 by the adhesive 300. Therefore, it is possible to suppress a decrease in the sealing performance of the first seal member 220.

Further, since the liquid ejecting apparatus 100 includes the connector Cn provided on the circuit substrate 230 and the flexible flat cable 113 coupled to the connector Cn, it is possible to transmit the drive signal to the COF substrate 242 via the flexible flat cable 113.

B. Second Embodiment

Figure 17:
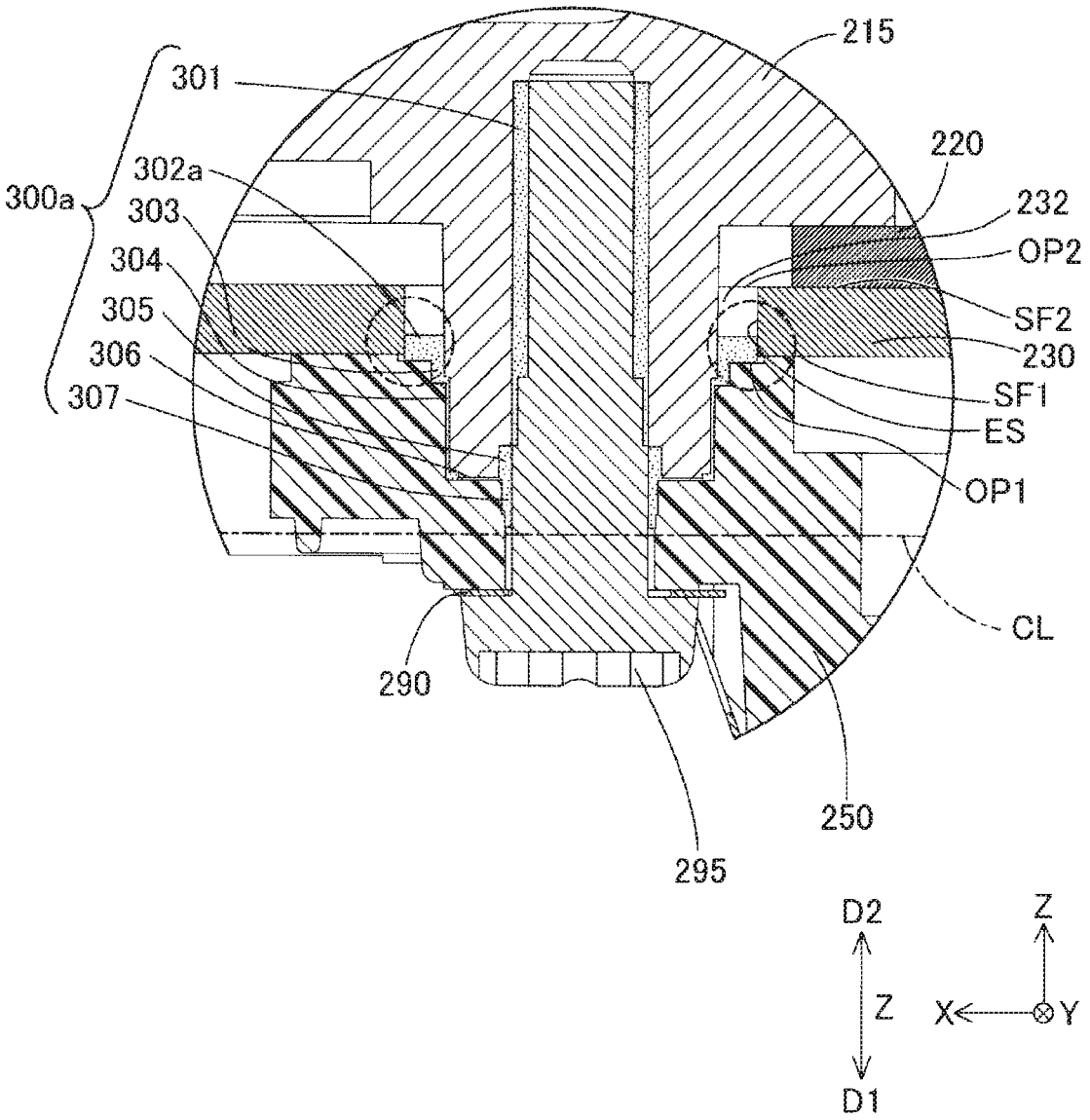
FIG. 17 is an explanatory view illustrating a configuration of adhesives included in a liquid ejecting head according to a second embodiment.

FIG. 17 is an explanatory view illustrating a configuration of an adhesive 300*a* provided in a liquid ejecting head according to a second embodiment. The adhesive 300*a* of the second embodiment is different from the adhesive 300 of the first embodiment in that a second adhesive 302*a* is provided instead of the second adhesive 302. Other configurations are the same as those of the first embodiment, and therefore, the same configurations are denoted by the same reference numerals, and detailed description thereof will be omitted. FIG. 17 illustrates a region corresponding to the region XV illustrated in FIG. 15.

As illustrated in a circle of a broken line in FIG. 17, the second adhesive 302*a* extends beyond, on the second direction D2 side, an opening Op1 of the circuit substrate 230 on the first direction D1 side, and is also disposed inside the second through-hole 232. The second adhesive 302*a* inside the second through-hole 232 does not exceed, on the second direction D2 side, an opening Op2 of the circuit substrate 230 on the second direction D2 side, and does not adhere to a surface SF2 of the circuit substrate 230 on the second direction D2 side. Further, the second adhesive 302*a* does not adhere to the surface SF1 of the circuit substrate 230 on the first direction D1 side, as in the first embodiment.

According to the liquid ejecting head of the second embodiment described above, the same effects as those of the first embodiment can be obtained. In addition, the adhesive 300*a* does not adhere to the surface SF1 of the circuit substrate 230 on the first direction D1 side, that is, the surface on the side where the flow path forming member 270 is disposed. Therefore, an occurrence of electrical failure due to the adhesion of the adhesive 300*a* to the surface SF1 of the circuit substrate 230 on the first direction D1 side can be suppressed.

C. Third Embodiment

Figure 18:
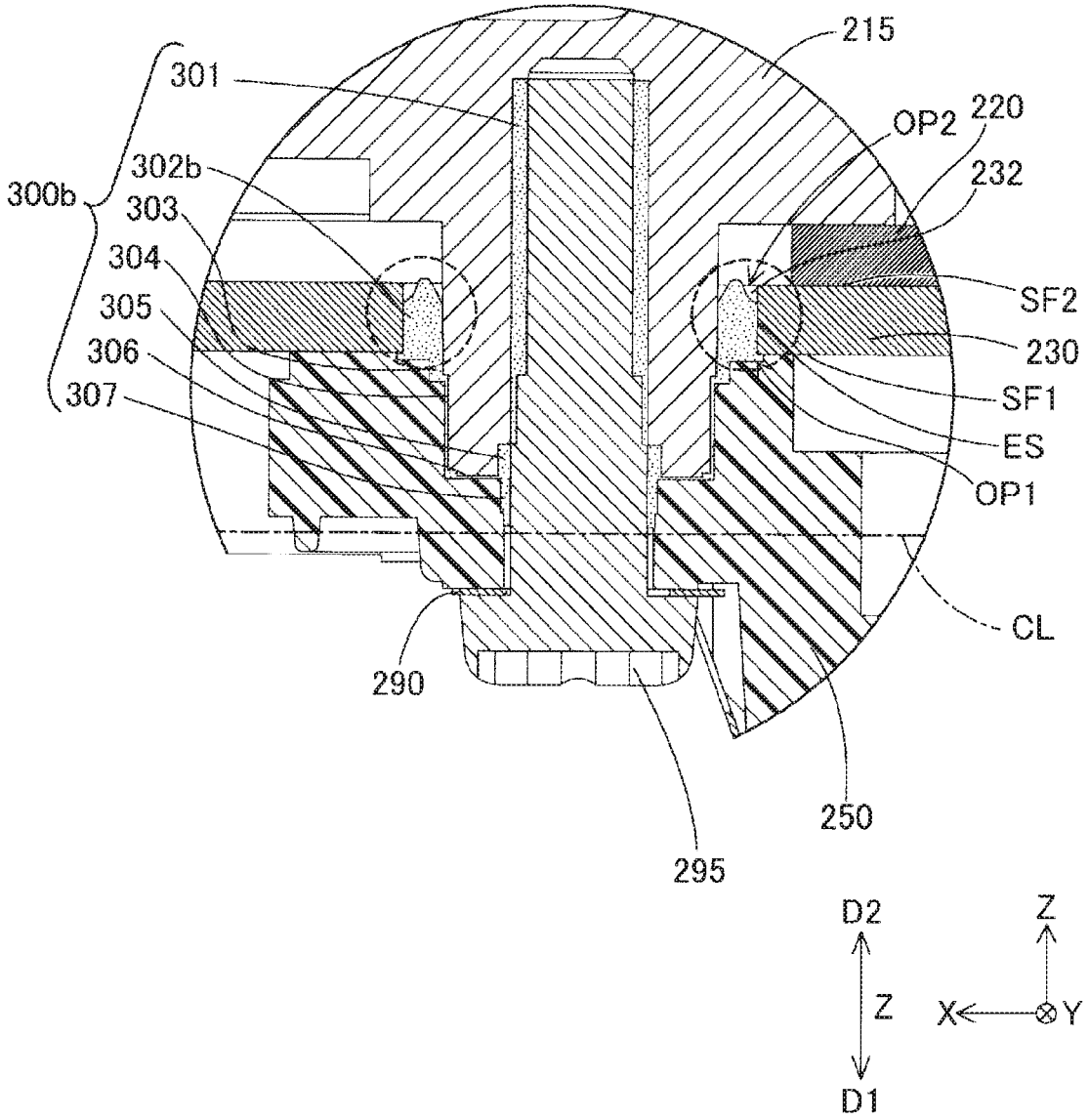
FIG. 18 is an explanatory view illustrating a configuration of adhesives included in a liquid ejecting head according to a third embodiment.

FIG. 18 is an explanatory view illustrating a configuration of an adhesive 300*b* included in a liquid ejecting head according to a third embodiment. The adhesive 300*b* according to the third embodiment is different from the adhesive 300*a* according to the second embodiment in that a second adhesive 302*b* is provided instead of the second adhesive 302*a*. Other configurations are the same as those of the second embodiment, and therefore, the same configurations are denoted by the same reference numerals, and detailed description thereof will be omitted. FIG. 18 illustrates a region corresponding to the region XV illustrated in FIG. 15.

As illustrated in a circle of a broken line in FIG. 18, the second adhesive 302*b* extends, on the second direction D2, beyond the opening Op1 of the circuit substrate 230 on the first direction D1 side, as in the second embodiment, and is also disposed inside the second through-hole 232. Different from the second embodiment, the second adhesive 302*b* inside the second through-hole 232 is disposed, on the second direction D2 side, beyond the opening Op2 of the circuit substrate 230 on the second direction D2 side. A portion of the second adhesive 302*b*, which is disposed on the second direction D2 side from the surface SF2 of the circuit substrate 230 on the second direction D2 side is not disposed on the direction side away from the protrusion portion 216 from the position of the end surface ES of the circuit substrate 230 in the X direction. That is, the adhesive 300*b* does not adhere to the surface SF2 of the circuit substrate 230 on the second direction D2 side. On the other hand, a portion of the second adhesive 302*b* that is disposed on the first direction D1 side from the surface SF1 of the circuit substrate 230 on the first direction D1 side extends on the direction side away from the protrusion portion 216 from the position of the end surface ES of the circuit substrate 230 in the X direction, and adheres to the surface SF1 of the circuit substrate 230 on the first direction D1 side.

According to the liquid ejecting head of the third embodiment described above, the adhesive 300*b* extends from between the protrusion portion 216 and the recess portion 251 to the inside of the second through-hole 232, and does not adhere to the surface SF2 of the circuit substrate 230 on the second direction D2 side. Therefore, an occurrence of electrical failure due to the adhesion of the adhesive 300*b* to the surface SF2 of the circuit substrate 230 on the second direction D2 side can be suppressed.

D. Fourth Embodiment

Figure 19:
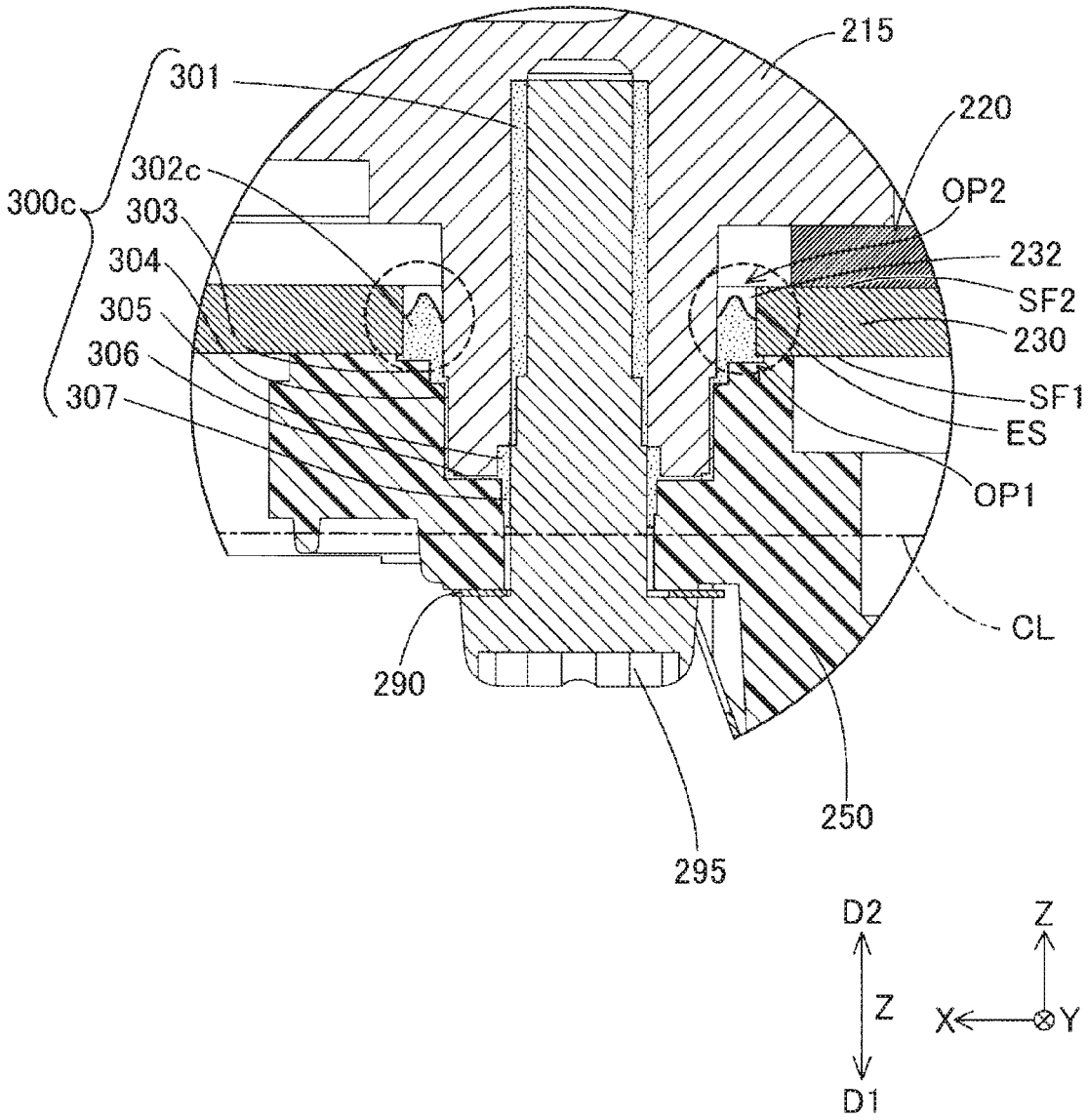
FIG. 19 is an explanatory view illustrating a configuration of adhesives included in a liquid ejecting head according to a fourth embodiment.

FIG. 19 is an explanatory view illustrating a configuration of an adhesive 300*c* included in a liquid ejecting head according to a fourth embodiment. The adhesive 300*c* of the fourth embodiment is different from the adhesive 300*b* of the third embodiment in that a second adhesive 302*c* is provided instead of the second adhesive 302*a*. Other configurations are the same as those of the third embodiment, and therefore, the same configurations are denoted by the same reference numerals, and detailed description thereof will be omitted. FIG. 19 illustrates a region corresponding to the region XV illustrated in FIG. 15.

As illustrated in a circle of a broken line in FIG. 19, unlike the third embodiment, the second adhesive 302*c* is different from that of the third embodiment in that the portion disposed in the second through-hole 232 does not exceed, on the second direction D2 side, the opening Op2 of the circuit substrate 230 on the second direction D2 side.

According to the liquid ejecting head of the fourth embodiment described above, the same effects as those of the third embodiment can be obtained. In addition, the adhesive 300*c* extends from between the protrusion portion 216 and the recess portion 251 to the inside of the second through-hole 232 and does not exceed the opening Op2 of the second through-hole 232 on the second direction D2 side.

Therefore, an occurrence of electrical failure due to the adhesion of the adhesive 300*c* to the surface SF2 of the circuit substrate 230 on the second direction D2 side can be suppressed.

E. Fifth Embodiment

Figure 20:
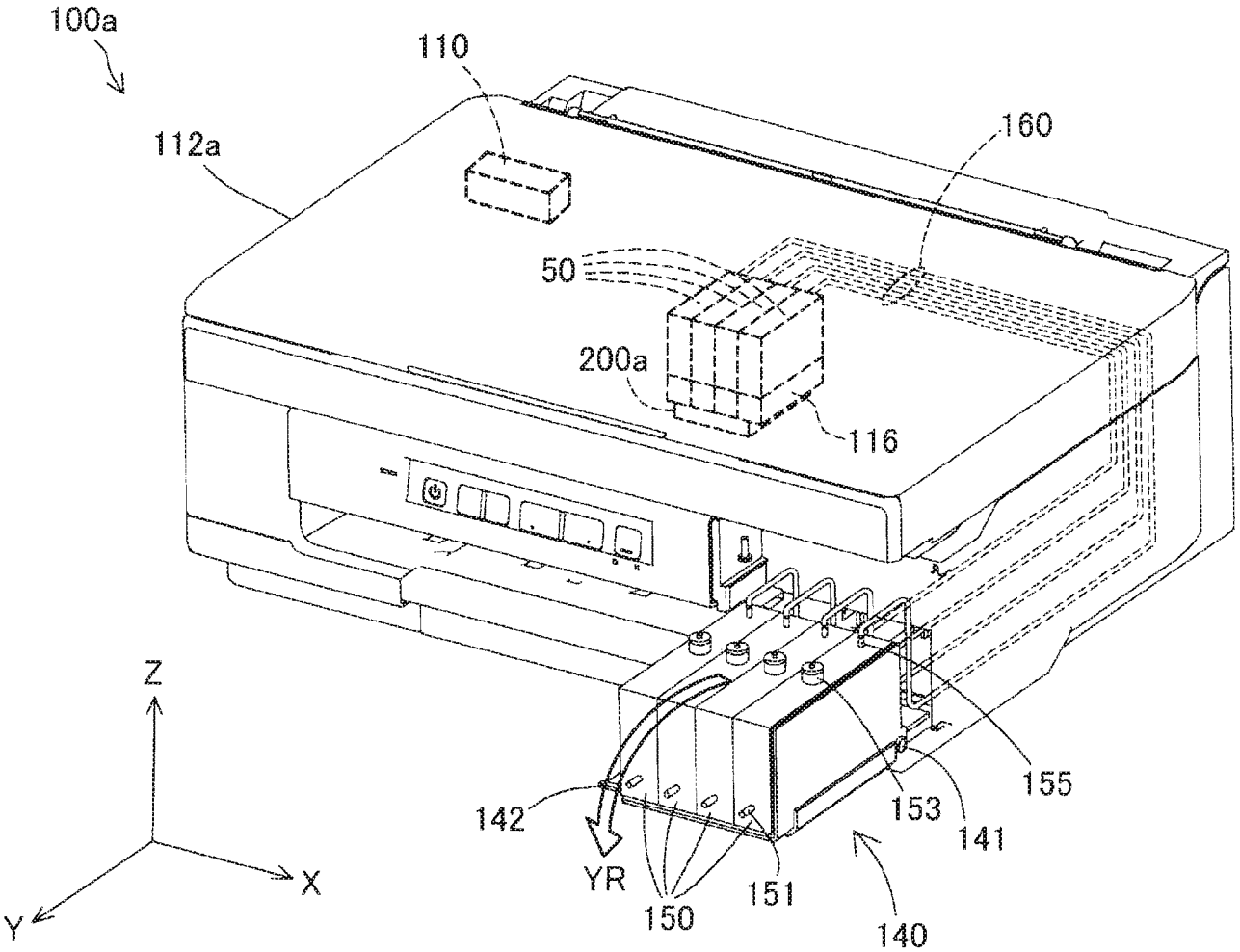
FIG. 20 is an explanatory view illustrating a schematic configuration of a liquid ejecting apparatus including a liquid ejecting head according to a fifth embodiment.

FIG. 20 is an explanatory view illustrating a schematic configuration of a liquid ejecting apparatus 100*a* including a liquid ejecting head 200*a* according to a fifth embodiment. The liquid ejecting apparatus 100*a* is different from the liquid ejecting apparatus 100 according to the first embodiment in that a housing 112*a* is provided instead of the housing 112, an ink tank 150 and a pressure regulation valve 50 are provided instead of the ink cartridge 117, and a tube 160 is added. The liquid ejecting head 200*a* differs from the liquid ejecting head 200 according to the first embodiment in that the liquid ejecting head 200*a* includes a holder 210*a* having an ink supply needle 205 instead of the holder 210. Other configurations are the same as those of the first embodiment, and therefore, the same configurations are denoted by the same reference numerals, and detailed description thereof will be omitted. In FIG. 20, an internal configuration of the liquid ejecting apparatus 100*a* is indicated by a broken line. FIG. 20 illustrates a state where ink can be injected into the ink tank 150. The ink tank 150 is an example of a "liquid storage section", the pressure regulation valve 50 is an example of a "pressure regulation section", and the ink supply needle 205 is an example of a "needle".

The housing 112*a* has a substantially rectangular parallelepiped shape. The housing 112*a* includes a front surface, a back surface, a left side surface, a right side surface, an upper surface, and a bottom surface, and the six surfaces form the housing 112*a* that is an outer shell of the liquid ejecting apparatus 100*a*.

The ink tank 150 accommodates ink inside. The ink tank 150 is accommodated in an accommodation mechanism 140 provided in a portion on the right side of the front surface of the liquid ejecting apparatus 100*a*. The accommodation mechanism 140 has a plate-like case 142 that constitutes a part of the front surface of the housing 112*a*. The case 142 has a rectangular shape, and is provided, at a lower portion, with a hinge 141 for fixing the case 142 to the housing 112*a* and capable of rotating the case 142 in an arrow YR direction with a lower portion as a fulcrum. The ink tank 150 is detachably attached to the case 142. The accommodation mechanism 140 is accommodated inside the housing 112*a* in a state where the liquid ejecting apparatus 100*a* is in use, and when injecting ink into the ink tank 150, the user rotates an upper portion of the case 142 in the arrow YR direction. Therefore, the ink tank 150 is exposed outside the liquid ejecting apparatus 100*a*. The ink tank 150 may not be accommodated inside the housing 112*a*, but may be provided outside the housing 112*a*.

For example, four ink tanks 150 are provided, and respective ink tanks 150 accommodate ink of different colors. Respective ink tanks 150 are disposed side by side in the X direction. The ink tank 150 includes a liquid injection port 153 for injecting ink into the inside, an atmosphere opening port 151 for introducing air into the inside as the ink is consumed, and a liquid deriving portion 155 coupled to the tube 160, which is described later, for deriving the ink toward the liquid ejecting head 200*a*. A configuration in which the liquid injection port 153 is not provided in the ink tank 150 may be provided.

The ink tank 150 is coupled to the pressure regulation valve 50 provided between the holder 210*a* and the ink tank 150 by the tube 160 as a liquid supply flow path. Four pressure regulation valves 50 are provided corresponding to the respective ink tanks 150 accommodating the ink of respective colors. A detailed configuration of the pressure regulation valve 50 will be described later. The tube 160 is formed of a flexible member such as synthetic rubber.

Figure 21:
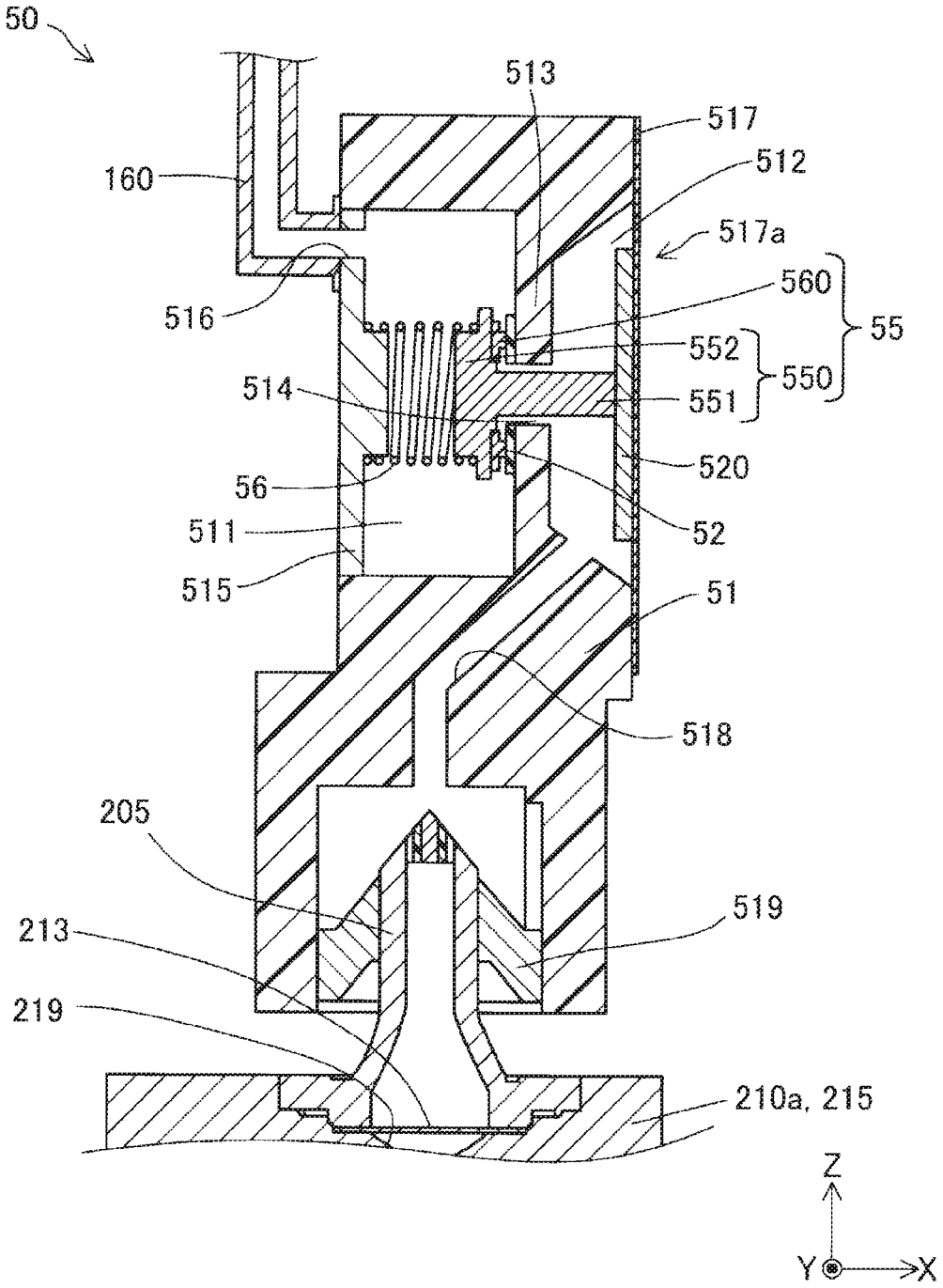
FIG. 21 is a sectional view illustrating a detailed configuration of a pressure regulation valve.

FIG. 21 is a sectional view illustrating a detailed configuration of the pressure regulation valve. FIG. 21 illustrates a cross section of the tube 160, the pressure regulation valve 50, and the holder 210*a*, which are cut in an X-Z plane. In FIG. 21, a portion of the holder 210*a* where the ink supply needle 205 is provided is illustrated in an enlarged manner, and configurations other than the portion are not illustrated. In the present embodiment, since the configurations of the plurality of pressure regulation valves 50 are basically the same, the description will focus on any one of the pressure regulation valves 50.

The pressure regulation valve 50 temporarily stores ink supplied from the ink tank 150 via the tube 160, and the ink temporarily stored in the pressure regulation valve 50 is supplied to the liquid ejecting head 200*a*. The pressure regulation valve 50 is fixed by the holder 210*a* and the carriage 116. The pressure regulation valve 50 may be fixed only by the holder 210*a*. Although not illustrated in FIG. 21, a pressure-feeding unit for pressure-feeding the ink in the ink tank 150 toward the liquid ejecting head 200*a* is provided in the middle of the ink tank 150 and the tube 160, or the like disposed upstream of the pressure regulation valve 50. For example, the pressure-feeding unit includes a pressing unit that presses the ink tank 150 from outside, a pressure pump, or the like. A water head pressure difference generated by regulating a relative position of the liquid ejecting head 200*a* and the ink tank 150 in the direction of gravity may be used as the pressure-feeding unit.

In the holder 210*a*, the ink supply needle 205 is provided on a filter 213. The ink supply needle 205 includes a disk-shaped member and a needle member protruding in the +Z direction. A through-hole penetrating in the Z direction is provided inside the ink supply needle 205, and the through-hole functions as an ink flow path. The ink supply needle 205 is inserted into the pressure regulation valve 50. The ink supplied from the pressure regulation valve 50 passes through the inside of the ink supply needle 205, foreign matters are removed by the filter 213, and then the ink is supplied to the nozzle 282 via the second flow path 219.

The pressure regulation valve 50 is provided in the middle of a flow path through which ink flows, and is configured by a valve that opens and closes the flow path. The pressure regulation valve 50 includes a housing 51 and a valve element 55 provided inside the housing 51.

The housing 51 is provided with a primary chamber 511 that communicates with the ink tank 150 via the tube 160 and is supplied with ink from the ink tank 150, and a secondary chamber 512 that communicates with the second flow path 219 of the holder 210*a*. The primary chamber 511 and the secondary chamber 512 are separated by a partition 513. The primary chamber 511 and the secondary chamber 512 communicate with each other via a communication flow path 514 provided through the partition 513.

The primary chamber 511 is formed by sealing a recess portion formed on one surface of the housing 51 with a lid member 515. The primary chamber 511 is coupled to the tube 160 via an inflow path 516 provided in the housing 51. The secondary chamber 512 has a recess shape that opens on a side surface of the housing 51 opposite to the primary chamber 511. A film 517 having flexibility is attached to a surface where the secondary chamber 512 opens, and the opening of the secondary chamber 512 is sealed with the film 517. Examples of the material of the film 517 include a high-density polyethylene film, polyethylene terephthalate (PET), and the like. One end of an outflow path 518 communicates with the secondary chamber 512, and a seal member 519 is provided at one end portion of the outflow path 518 opposite to the other end portion communicating with the secondary chamber 512. The ink supply needle 205 described above is inserted into the seal member 519 and coupled to the outflow path 518.

A portion of the film 517 that forms a part of a wall surface of the secondary chamber 512 is a diaphragm 517*a*. A pressure receiving plate 520 is provided on a surface of the diaphragm 517*a* on a secondary chamber 512 side. The pressure receiving plate 520 has a disk shape with an outer shape smaller than that of the diaphragm 517*a*. The pressure receiving plate 520 is provided to prevent the valve element 55 that opens and closes the communication flow path 514 from directly abutting against the film 517. As the pressure receiving plate 520, for example, a material having higher rigidity than that of the film 517 such as resin or metal can be used.

The housing 51 is formed, for example, by molding a resin material having higher rigidity than that of the film 517. A circumference of the opening of the partition 513 on the primary chamber 511 side is provided with a valve seat 52 against which the valve element 55 abuts. The valve element 55 is inserted into the communication flow path 514. The valve element 55 includes a valve element body 550 and an abutting member 560. The valve element body 550 includes a shaft portion 551 inserted into the communication flow path 514 and a flange portion 552 provided at an end portion of the shaft portion 551 inside the primary chamber 511.

The shaft portion 551 has an outer diameter slightly smaller than the communication flow path 514. One end portion of end portions of the shaft portion 551 disposed inside the secondary chamber 512 abuts against a central portion of the pressure receiving plate 520. The other end portion of the shaft portion 551 opposite to the one end portion abutting against the pressure receiving plate 520 is disposed inside the primary chamber 511, and the flange portion 552 is integrally formed. The valve element body 550 is movable in the +X direction and the −X direction.

The flange portion 552 is formed of a circular plate-like member. The abutting member 560 is fixed to the flange portion 552. The abutting member 560 is formed of an elastic material such as rubber or elastomer, and has a ring shape provided continuously in the circumference of the shaft portion 551. A spring 56 is provided between the flange portion 552 and the lid member 515 defining the primary chamber 511, and the valve element 55 is urged in the +X direction by an urging force of the spring 56. That is, the flange portion 552 functions as a spring receiver against which one end of the spring 56 abuts. When the flange portion 552 is urged by the spring 56, the abutting member 560 abuts against the valve seat 52, and the communication flow path 514 is closed, that is, the pressure regulation valve 50 is closed.

When the ink in the secondary chamber 512 flows downstream and the pressure inside the secondary chamber 512 is reduced to a negative pressure from the atmospheric pressure, the diaphragm 517*a* moves in the −X direction, and the pressure receiving plate 520 presses the valve element 55 against the urging force of the spring 56. Therefore, a gap is created between the abutting member 560 of the valve element 55 and the valve seat 52, and the communication flow path 514 opens, that is, the pressure regulation valve 50 opens. When the ink is supplied from the primary chamber 511 into the secondary chamber 512 by opening the pressure regulation valve 50, decompression inside the secondary chamber 512 is eliminated, and the diaphragm 517*a* is returned to its original position by the urging force of the spring 56. The communication flow path 514 is closed by the valve element 55, and the pressure regulation valve 50 is closed. As described above, the pressure regulation valve 50 can regulate the pressure of the ink supplied from the ink tank 150 to the liquid ejecting head 200*a*.

According to the liquid ejecting head 200*a* of the fifth embodiment described above, the same effects as those of the first embodiment can be obtained.

Further, since the pressure regulation valve 50 for regulating the pressure of the ink supplied to the liquid ejecting head 200*a* is provided between the ink tank 150 and the holder 210*a*, it is possible to stabilize the supply of the ink from the ink tank 150 to the liquid ejecting head 200*a*.

F. Another Embodiment 1 of Fifth Embodiment

A liquid ejecting apparatus according to another Embodiment 1 of the fifth embodiment is different from the liquid ejecting apparatus 100*a* according to the fifth embodiment in that a damper 170 is provided instead of the pressure regulation valve 50. Other configurations are the same as those of the fifth embodiment, and therefore, the same configurations are denoted by the same reference numerals, and detailed description thereof will be omitted.

Figure 22:
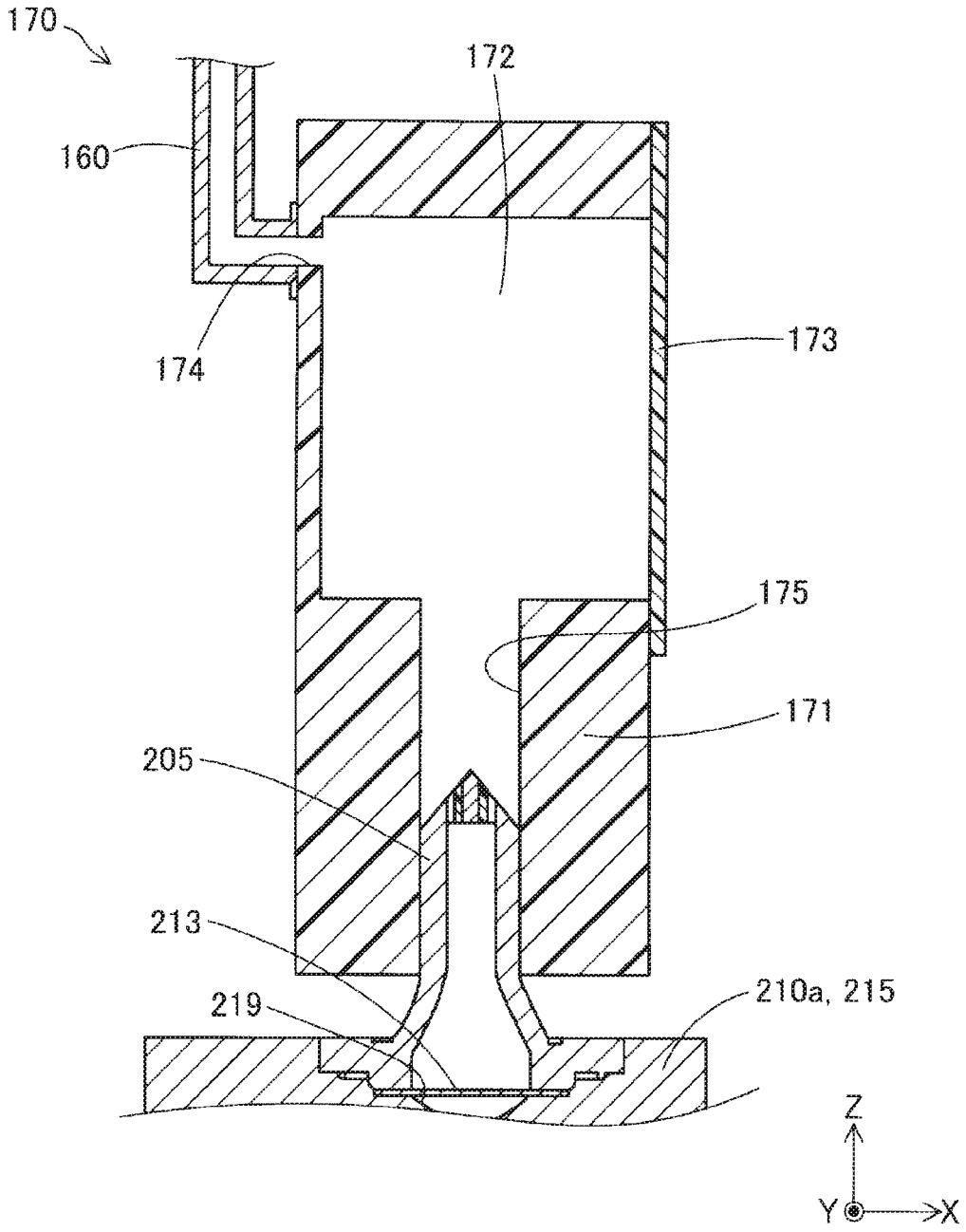
FIG. 22 is a sectional view illustrating a detailed configuration of a damper.

FIG. 22 is a sectional view illustrating a detailed configuration of the damper 170. FIG. 22 illustrates a cross section of the damper 170 which is cut in the X-Z plane. In FIG. 22, a portion where the ink supply needle 205 is provided in the holder 210*a* is illustrated in an enlarged manner, and configurations other than the portion are not illustrated.

As illustrated in FIG. 22, the damper 170 is provided between the tube 160 and the holder 210*a*, and is fixed to the holder 210*a*. The damper 170 absorbs a fluctuation in ink pressure caused by the movement of the carriage 116. The damper 170 includes a housing 171 and a flexible film 173. The housing 171 is formed from, for example, an elastic material such as rubber or an elastomer. The film 173 is formed from a film member made of, for example, a high-density polyethylene film or polyethylene terephthalate (PET).

The housing 171 is provided with an inflow port 174, an outflow port 175, and a damper chamber 172. The damper chamber 172 is defined by covering a recess-shaped space which is provided inside the housing 171 and is recessed in the −X direction, with a film 173 on the +X direction side. The inflow port 174 is a through-hole that penetrates an outer surface of the housing 171 in the +X direction. The inflow port 174 allows the tube 160 to communicate with the damper chamber 172. The outflow port 175 is a through-hole that penetrates the outer surface of the housing 171 in the −Z direction. An inner diameter of the outflow port 175 and an outer diameter of the ink supply needle 205 are substantially equal to each other, and when the ink supply needle 205 is inserted into the outflow port 175, the damper chamber 172 communicates with the ink supply needle 205.

As described above, the ink supplied from the ink tank 150 is supplied to the damper chamber 172 via the tube 160. The ink supplied to the damper chamber 172 is supplied to the second flow path 219 of the holder 210*a* via the ink supply needle 205. Since a part of the wall surface defining the damper chamber 179 is constituted by the flexible film 173, the pressure of the ink supplied to the liquid ejecting head 200*a* can be absorbed by the displacement of the film 173.

According to the other Embodiment 1 of the fifth embodiment described above, the liquid ejecting head includes the damper chamber 172 having the flexible film 173, between the ink tank 150 and the holder 210*a*. Therefore, the pressure fluctuation inside the flow path to the liquid ejecting head can be absorbed.

G. Further Another Embodiment 2 of Fifth Embodiment

A liquid ejecting apparatus according to further another Embodiment 2 of the fifth embodiment differs from the liquid ejecting apparatus 100*a* according to the fifth embodiment in that the pressure regulation valve 50 is omitted. Other configurations are the same as those of the fifth embodiment, and therefore, the same configurations are denoted by the same reference numerals, and detailed description thereof will be omitted.

Figure 23:
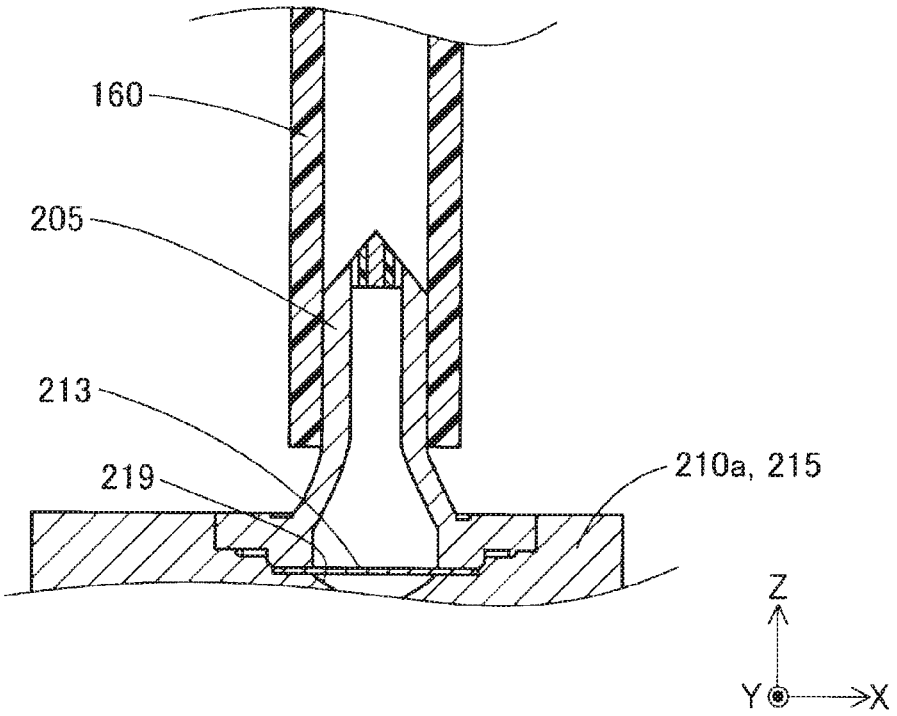
FIG. 23 is a sectional view illustrating configurations of a tube, an ink supply needle, and a holder according to another Embodiment 2 of the fifth embodiment.

FIG. 23 is a sectional view illustrating a configuration of a tube 160, an ink supply needle 205, and a holder 210*a* according to further another Embodiment 2 of the fifth embodiment. FIG. 23 illustrates a cross section of the tube 160 and the holder 210*a* which are cut in the X-Z plane. In FIG. 23, a portion of the holder 210*a* where the ink supply needle 205 is provided is illustrated in an enlarged manner, and configurations other than the portion are not illustrated.

As illustrated in FIG. 23, when the ink supply needle 205 is inserted into the tube 160, the tube 160 and the ink supply needle 205 are directly coupled. Therefore, the ink tank 150 and the second flow path 219 of the holder 210*a* are coupled via the tube 160.

According to the other Embodiment 2 of the fifth embodiment described above, since the tube 160 is provided as a supply flow path for supplying the ink inside the ink tank 150 to the second flow path 219 of the holder 210*a*, the ink inside the ink tank 150 can be supplied to the holder 210*a*.

Further, since the holder 210*a* includes the ink supply needle 205 for introducing the ink supplied from the tube 160 into the second flow path 219, the tube 160 and the second flow path 219 can be coupled. Thus, the ink can be supplied from the ink tank 150 to the liquid ejecting head.

H. Other Embodiments

Figure 24:
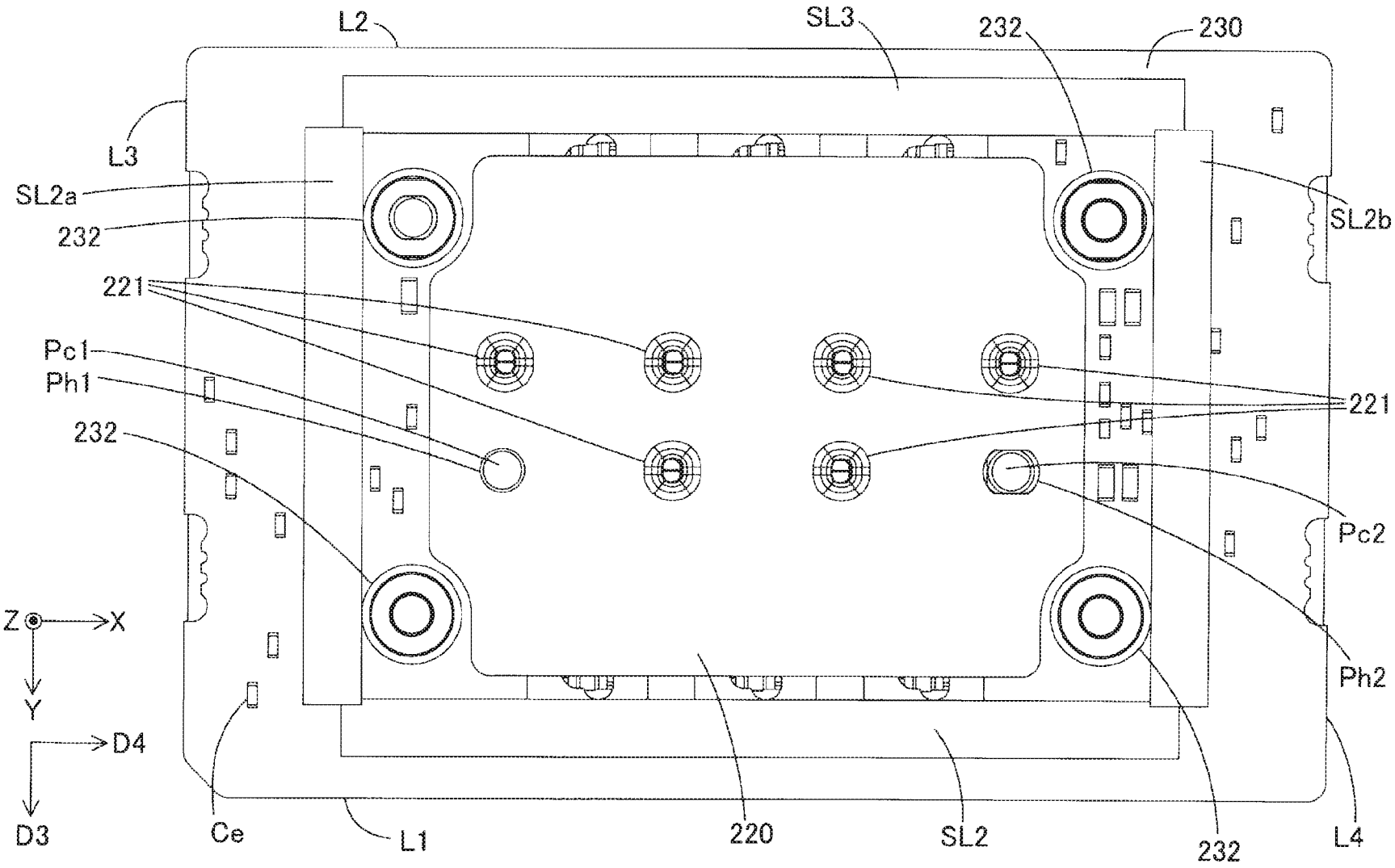
FIG. 24 is a plan view illustrating a placement position of a second seal member in further another Embodiment 1.

1. FIG. 24 is a plan view illustrating a placement position of a second seal member in another Embodiment 1. Similar to FIG. 8, FIG. 24 illustrates, a state where respective members constituting the liquid ejecting head are joined together, the liquid ejecting head in a state of being viewed in plan view in the second direction D2, in which the holder is removed. As illustrated in FIG. 24, on the surface of the circuit substrate 230 on the second direction D2 side, in addition to the second seal member SL2 and the third seal member SL3, second seal members SL2*a* and SL2*b* are disposed. The second seal member SL2*a* is disposed on the −X direction side of the two second through-holes 232 on the −X direction side, among the four second through-holes 232. The second seal member SL2*b* is disposed on the +X direction side of the two second through-holes 232 on the +X direction side, among the four second through-holes 232. Therefore, in the present embodiment, the second seal members SL2, SL2*a*, and SL2*b*, and the third seal member SL3 are disposed so as to surround the circumferences of the openings 233 and the second through-holes 232. In such a configuration, it is possible to suppress intrusion of the ink mist into the piezo or electrode portion inside the liquid ejecting head 200 via the opening 233 from between the circuit substrate 230 and the holders 210 and 210*a*, and it is possible to suppress the entry of the ink mist into the second through-hole 232.

2. In each of the embodiments described above, the adhesive for bonding the case 250, the vibration plate 260, the flow path forming member 270, and the nozzle plate 280 may be the same as the adhesives 300, 300*a*, 300*b*, and 300*c* for bonding the holder 210 and the case 250. By doing so, a curing time and a curing temperature of the adhesive can be the same between a case where the holder 210 and the case 250 are bonded, and a case where the flow path forming member 270 and the case 250 are bonded. Therefore, the liquid ejecting heads 200 and 200*a* can be assembled in a same facility, so that manufacturing costs of the liquid ejecting heads 200 and 200*a* can be reduced.

3. In each of the embodiments described above, the adhesives 300, 300*a*, 300*b*, and 300*c* may be disposed at positions where the holders 210 and 210*a*, and the case 250 can be fixed. Therefore, for example, a configuration in which the adhesive is not disposed at the placement positions of the adhesives 302, 303, 304, 305, and 306, that is, a configuration in which the adhesive is not disposed between the protrusion portion 216 and the recess portion 251 may be provided. Further, for example, a configuration in which the adhesive is not disposed at the placement position of the adhesive 307, that is, a configuration in which the adhesive is not disposed between the through-hole 335 of the recess portion 251 and the screw 295 may be provided. Further, for example, a configuration in which the adhesive is not disposed at the placement position of the adhesive 301, that is, a configuration in which the adhesive is not disposed between the screw 295 and the first portion 331 may be provided. Even in such a configuration, since the adhesive is disposed at a position where the holders 210 and 210*a*, and the case 250 can be fixed, it is possible to suppress a decrease in the sealing performance between the holders 210 and 210*a*, and the case 250.

4. In each of the embodiments described above, the second seal member SL2 and the third seal member SL3 may be disposed at positions overlapping with the nozzle 282 when viewed in the second direction D2. Further, the second seal member SL2 and the third seal member SL3 may be disposed at positions overlapping with the flow path pipe FP when viewed in the second direction D2. Further, the second seal member SL2 and the third seal member SL3 may be disposed at positions overlapping with the first seal member 220. Further, the second seal member SL2 and the third seal member SL3 may be disposed at positions overlapping with the circuit element Ce. Even in such a configuration, the second seal member SL2 and the third seal member SL3 are disposed between the circuit substrate 230 and the holders 210 and 210*a* at a portion between the outer edge of the circuit substrate 230 and the opening 233. Therefore, it is possible to suppress the intrusion of the ink mist into the piezo and the electrode portion inside the liquid ejecting heads 200 and 200*a* via the opening 233 from between the circuit substrate 230 and the holders 210 and 210*a*.

5. In the fifth embodiment described above, the liquid ejecting apparatus 100*a* may include an intermediate tank for temporarily storing the ink instead of the pressure regulation valve 50.

6. In the fifth embodiment described above, the pressure regulation valve 50 is employed as an example of the pressure regulation section. However, the configuration of the pressure regulation section is not limited thereto. For example, the pressure of the ink in the flow path may be regulated by an opening/closing valve that performs a mechanical opening/closing operation with a cam mechanism driven by the control of the control section 110, or the like.

7. In the first to fifth embodiments described above, in the liquid ejecting heads 200 and 200*a* may not have the second seal member SL2.

8. In each of the embodiments described above, the liquid ejected from the nozzle 282 may be a liquid other than ink. For example, the liquid may be:

1. a color material used for manufacturing a color filter for an image display device such as a liquid crystal display
2. an electrode material used for forming an electrode of an organic electro luminescence (EL) display, a field emission display (FED), or the like
3. a liquid containing a biological organic matter used for biochip production
4. a sample as a precision pipette
5. a lubricating oil
6. a resin liquid
7. a transparent resin liquid such as an ultraviolet-curable resin liquid for forming a micro hemispherical lens (optical lens) used for an optical communication element or the like
8. a liquid ejecting an acidic or alkaline etching liquid to etch a substrate or the like
9. any other small amount of liquid droplets The term "droplets" refers to the state of the liquid ejected from the liquid ejecting apparatuses 100 and 100*a*, and also includes those that trail in a granular shape, a tear shape, and a thread shape. The "liquid" here may be any material that can be consumed by the liquid ejecting apparatuses 100 and 100*a*. For example, a material in a state where a substance is in a liquid phase, a material in a high or low viscosity liquid state, and a liquid material such as a sol, gel water, inorganic solvent, organic solvent, solution, liquid resin, and liquid metal (metal melt) are also included in the "liquid". In addition, not only a liquid as one state of a substance but also a liquid in which particles of a functional material formed of a solid such as a pigment or metal particles are dissolved, dispersed, or mixed in a solvent is also included in the "liquid". Representative examples of the liquid include ink, liquid crystal, and the like. Here, the ink includes various liquid compositions such as general liquid ink, oil-based ink, gel ink, and hot melt ink. In these configurations, the same effects as those of each of the embodiments can be obtained.

I. Other Forms

The present disclosure is not limited to the embodiments described above, and can be implemented with various configurations without departing from the spirit thereof. For example, the technical features in the embodiments corresponding to the technical features in each aspect described in the summary of the present disclosure may be used to solve some or all of the problems described above, or to achieve a part or all of the effects, a replacement or a combination thereof can be appropriately performed. Unless the technical features are described as essential in the present specification, they can be deleted as appropriate.

1. According to an embodiment of the present disclosure, a liquid ejecting head is provided. The liquid ejecting head includes: a nozzle plate provided with a plurality of nozzles ejecting a liquid in a first direction; a case provided in a second direction that is opposite to the first direction with respect to the nozzle plate, and having a flow path pipe that defines a first flow path through which the liquid flows and which protrudes in the second direction; a circuit substrate provided in the second direction with respect to the case and having a first through-hole through which the flow path pipe penetrates; a first seal member provided in the second direction with respect to the circuit substrate; a holder provided in the second direction with respect to the first seal member and having therein a second flow path communicating with the first flow path; a screw fixing the holder to the case; and an adhesive fixing the holder to the case.

According to the liquid ejecting head of the aspect, there are provided with the case, the circuit substrate provided in the second direction with respect to the case, the first seal member provided in the second direction with respect to the circuit substrate, the holder provided in the second direction with respect to the first seal member, the screw fixing the holder to the case, and the adhesive fixing the holder to the case. Therefore, even if the fastening force of the screw is decreased, it is possible to suppress a decrease in the sealing performance between the holder and the case.

2. In the liquid ejecting head according to the above aspect, the holder may have a protrusion portion protruding in the first direction, the case may have a recess portion that fits to the protrusion portion, and a through-hole which penetrates a bottom surface of the recess portion and into which the screw is inserted, the protrusion portion may have therein a screw hole fixing the screw, and the adhesive may be provided between the protrusion portion and the recess portion.

According to the liquid ejecting head of the aspect, the holder has the protrusion portion, the case has the recess portion to be fit to the protrusion portion, and the adhesive is provided between the protrusion portion and the recess portion. Therefore, it is possible to suppress leakage of the adhesive to the outside.

3. In the liquid ejecting head according to the above aspects, the adhesive may be provided between the through-hole and the screw.

According to the liquid ejecting head of the aspect, since the adhesive is provided between the through-hole and the screw, it is possible to suppress a decrease in the fastening force of the screw.

4. In the liquid ejecting head according to the above aspects, the screw hole may have a first portion and a second portion closer to an opening of the screw hole than the first portion, a diameter of the first portion may be smaller than a diameter of the second portion, and the adhesive may be provided between the screw and the first portion.

According to the liquid ejecting head of the aspect, the screw hole has the first portion and the second portion closer to the opening of the screw hole than the first portion, the diameter of the first portion is smaller than the diameter of the second portion, and the adhesive is provided between the screw and the first portion. Therefore, the adhesive can adhere to the screw groove portion of the screw hole corresponding to the inside of the protrusion portion on the second direction side, and a decrease in the fastening force of the screw can be reduced.

5. In the liquid ejecting head according to the above aspects, the circuit substrate may have a second through-hole into which the protrusion portion is inserted, and the adhesive may extend from between the protrusion portion and the recess portion to an inside of the second through-hole, and may not adhere to a surface of the circuit substrate on a second direction side.

According to the liquid ejecting head of the aspect, the adhesive extends from between the protrusion portion and the recess portion to the inside of the second through-hole, and does not adhere to the surface of the circuit substrate on the second direction side. Therefore, an occurrence of electrical failure due to the adhesion of the adhesive to the surface of the circuit substrate can be suppressed.

6. In the liquid ejecting head according to the above aspects, the circuit substrate may have a second through-hole into which the protrusion portion is inserted, and the adhesive may extend from between the protrusion portion and the recess portion to an inside of the second through-hole, and may not exceed an opening of the second through-hole on a second direction side.

According to the liquid ejecting head of the aspect, the adhesive extends from between the protrusion portion and the recess portion to the inside of the second through-hole, and does not exceed the opening of the second through-hole on the second direction side. Therefore, an occurrence of electrical failure due to the adhesion of the adhesive to the surface of the circuit substrate can be suppressed.

7. In the liquid ejecting head according to the above aspects, the adhesive may not adhere to a surface of the circuit substrate on a first direction side.

According to the liquid ejecting head of the aspect, the adhesive does not adhere to the surface of the circuit substrate on the first direction side, that is, the surface on the side where the flow path forming member is disposed. Therefore, an occurrence of electrical failure due to the adhesion of the adhesive to the surface of the circuit substrate on the first direction side can be suppressed.

8. The liquid ejecting head according to the above aspects may further include a flow path forming member provided between the nozzle plate and the case, and defining a third flow path communicating with the first flow path, and the adhesive bonding the holder and the case may be identical with the adhesive bonding the flow path forming member and the case.

According to the liquid ejecting head of the aspect, the adhesive bonding the holder and the case is the same as the adhesive bonding the flow path forming member and the case. Therefore, a curing time and a curing temperature of the adhesive can be the same between a case where the holder and the case are bonded and a case where the flow path forming member and the case are bonded. Therefore, the liquid ejecting head can be assembled in a same facility, so that the manufacturing cost of the liquid ejecting head can be reduced.

9. The liquid ejecting head according to the above aspects may further include a COF substrate coupled to the circuit substrate, and the circuit substrate may have an opening into which the COF substrate is inserted, and a second seal member may be provided between the circuit substrate and the holder, at a portion between an outer edge of the circuit substrate and the opening.

According to the liquid ejecting head of the aspect, the circuit substrate is provided with the opening into which the COF substrate is inserted, and the second seal member is provided between the circuit substrate and the holder, at the portion between the outer edge of the circuit substrate and the opening. Therefore, it is possible to suppress intrusion of ink mist into a piezo and an electrode portion inside the liquid ejecting head via the opening from between the circuit substrate and the holder. As a result, it is possible to suppress the occurrence of electrical failure of the liquid ejecting head.

10. In the liquid ejecting head according to the above aspects, the circuit substrate may have first and second sides in a fourth direction orthogonal to the first direction, and third and fourth sides in a third direction orthogonal to the first direction and the fourth direction. A distance between the opening and the first side in the third direction and, a distance between the opening and the second side in the third direction may be shorter than a distance between the opening and the third side in the fourth direction, and a distance between the opening and the fourth side in the fourth direction. The second seal member may be provided between the first side and the opening in the third direction.

According to the liquid ejecting head of the aspect, the distance between the opening and the first side in the third direction, and the distance between the opening and the second side in the third direction are shorter than the distance between the opening and the third side in the fourth direction, and the distance between the opening and the fourth side in the fourth direction. The second seal member is provided between the first side and the opening in the third direction. Therefore, the distance between the opening and the outer edge of the circuit substrate can be shorter, and the second seal member can be provided at a location where ink mist can easily enter. Therefore, it is possible to further suppress entry of the ink mist into the opening of the circuit substrate.

11. In the liquid ejecting head according to the above aspects, the second seal member may not overlap with the plurality of nozzles in plan view in the second direction.

According to the liquid ejecting head of the aspect, the second seal member does not overlap with the plurality of nozzles in plan view in the second direction. Therefore, it is possible to reduce the reaction force of the second seal member generated by disposing the second seal member between the circuit substrate and the holder. Therefore, it is possible to suppress the occurrence of the deviation in the nozzle surface due to the reaction force of the second seal member.

12. In the liquid ejecting head according to the above aspects, a third seal member may be provided between the second side and the opening in the third direction.

According to the liquid ejecting head of the aspect, since the third seal member is provided between the second side and the opening in the third direction. Therefore, it is possible to further suppress the entry of the ink mist into the opening of the circuit substrate.

13. In the liquid ejecting head according to the above aspects, the second seal member may not overlap with the flow path pipe in plan view in the second direction.

According to the liquid ejecting head of the aspect, the second seal member does not overlap with the flow path pipe in plan view in the second direction. Therefore, it is possible to suppress generation of a gap between the circuit substrate and the second seal member. Therefore, it is possible to further suppress the entry of the ink mist into the opening of the circuit substrate.

14. In the liquid ejecting head according to the above aspects, the holder may have the protrusion portion protruding in the first direction, the protrusion portion may have therein the screw hole fixing the screw, and the second seal member may not overlap with the protrusion portion in plan view in the second direction.

According to the liquid ejecting head of the aspect, the second seal member does not overlap with the protrusion portion in plan view in the second direction. Therefore, it is possible to suppress generation of a gap between the holder and the second seal member. Therefore, it is possible to further suppress the entry of the ink mist into the opening of the circuit substrate.

15. In the liquid ejecting head according to the above aspects, the second seal member may not overlap with the first seal member in plan view in the second direction.

According to the liquid ejecting head of the aspect, the second seal member does not overlap with the first seal member in plan view in the second direction. Therefore, it is possible to suppress generation of a gap between the circuit substrate and the second seal member. Therefore, it is possible to further suppress the entry of the ink mist into the opening of the circuit substrate.

16. In the liquid ejecting head according to the above aspects, a circuit element may be provided on a surface of the circuit substrate on a second direction side, and the second seal member may not overlap with the circuit element in plan view in the second direction.

According to the liquid ejecting head of the aspect, the circuit element is provided on the surface of the circuit substrate on the second direction side, and the second seal member does not overlap with the circuit element in plan view in the second direction. Therefore, it is possible to suppress generation of a gap between the circuit substrate and the second seal member. Therefore, it is possible to further suppress the entry of the ink mist into the opening of the circuit substrate.

17. In the liquid ejecting head according to the above aspects, a hardness of the second seal member may be lower than a hardness of the first seal member.

According to the liquid ejecting head of the aspect, the hardness of the second seal member is lower than the hardness of the first seal member. Therefore, it is possible to reduce a reaction force of the second seal member generated by disposing the second seal member between the circuit substrate and the holder. As a result, it is possible to suppress the occurrence of the deviation in the nozzle surface due to the reaction force of the second seal member.

18. In the liquid ejecting head according to the above aspects, a thickness of the second seal member may be 0.7 mm or more.

According to the liquid ejecting head of the aspect, the thickness of the second seal member is 0.7 mm or more. Therefore, it is possible to further suppress the entry of the ink mist into the opening of the circuit substrate. In addition, it is possible to reduce the reaction force of the second seal member generated by disposing the second seal member between the circuit substrate and the holder. Therefore, it is possible to suppress the occurrence of the deviation in the nozzle surface due to the reaction force of the second seal member.

19. In the liquid ejecting head according to the above aspects, the second seal member may be a double-sided tape.

According to the liquid ejecting head of the aspect, since the second seal member is the double-sided tape, it is possible to improve an adhesive strength between the circuit substrate and the holder.

20. According to another aspect of the present disclosure, a liquid ejecting apparatus is provided. The liquid ejecting apparatus includes the liquid ejecting head according to any one of the above aspects; and a liquid storage section storing a liquid to be supplied to the liquid ejecting head.

According to the liquid ejecting apparatus of the aspect, the liquid ejecting apparatus includes the liquid ejecting head according to any one of the above aspects; and the liquid storage section storing the liquid to be supplied to the liquid ejecting head. Therefore, even if a fastening force of the screw is decreased, it is possible to suppress a decrease in the sealing performance between the holder and the case in the liquid ejecting head. As a result, it is possible to suppress an occurrence of a defect of the liquid ejecting apparatus.

21. The liquid ejecting apparatus according to the above aspect may include a supply flow path supplying the liquid inside the liquid storage section to the second flow path inside the holder.

According to the liquid ejecting apparatus of the aspect, the supply flow path is provided for supplying the liquid inside the liquid storage section to the second flow path inside the holder. Therefore, it is possible to supply the liquid inside the liquid storage section to the holder.

22. In the liquid ejecting apparatus according to the above aspects, the supply flow path may be constituted by a tube, and the holder may have a needle that fits to the tube for introducing the liquid from the supply flow path into the second flow path.

According to the liquid ejecting apparatus of the aspect, the supply flow path is constituted by the tube, and the holder has the needle for introducing the liquid from the supply flow path into the second flow path. Therefore, the supply flow path and the second flow path can be coupled. Therefore, the liquid can be supplied from the liquid storage section to the liquid ejecting head.

23. The liquid ejecting apparatus according to the above aspects may further include a pressure regulation valve provided between the liquid storage section and the holder, and regulating a pressure of the liquid supplied to the liquid ejecting head.

According to the liquid ejecting apparatus of the aspect, since the pressure regulation valve is provided between the liquid storage section and the holder to regulate the pressure of the liquid supplied to the liquid ejecting head. Therefore, it is possible to stabilize the supply of the liquid from the liquid storage section to the liquid ejecting head.

24. The liquid ejecting apparatus according to the above aspects may further include a damper chamber provided between the liquid storage section and the holder, and having a flexible film.

According to the liquid ejecting apparatus of the aspect, since the damper chamber having the flexible film is provided between the liquid storage section and the holder. Therefore, a pressure fluctuation in the flow path of the liquid ejecting head can be absorbed.

25. In the liquid ejecting apparatus according to the above aspects, a direction in which the screw advances when the screw is tightened may be a direction opposite to a direction of gravity.

According to the liquid ejecting apparatus of the aspect, the direction in which the screw advances by tightening the screw is the direction opposite to the direction of gravity. Therefore, due to the configuration of the liquid ejecting head, even if the screws have to be tightened in the direction opposite to the direction of gravity, where the screws are easily released, it is possible suppress that fixing of the case and the holder is released by fixing the case and the holder by the adhesive. Therefore, it is possible to suppress a decrease in the sealing performance of the first seal member.

26. The liquid ejecting apparatus according to the above aspects may further include a connector provided on the circuit substrate; and a signal cable coupled to the connector.

According to the liquid ejecting apparatus of the aspect, the connector provided on the circuit substrate, and the signal cable coupled to the connector are provided. Therefore, it is possible to transmit a drive signal to the COF substrate via the signal cable.

The present disclosure can be realized in various forms. For example, it can be realized in forms of a liquid ejecting head, a liquid ejecting apparatus including the liquid ejecting head, a liquid ejecting system, and the like.

What is claimed is:

1. A liquid ejecting head comprising:

a nozzle plate provided with nozzles configured to eject a liquid in a first direction;

a case provided in a second direction that is opposite to the first direction with respect to the nozzle plate, and having a flow path pipe that defines a first flow path through which the liquid flows and which protrudes in the second direction;

a circuit substrate provided in the second direction with respect to the case and having a first through-hole through which the flow path pipe penetrates;

a first seal member provided in the second direction with respect to the circuit substrate;

a holder provided in the second direction with respect to the first seal member and having therein a second flow path communicating with the first flow path;

a screw fixing the holder to the case; and an adhesive fixing the holder to the case, wherein the holder has a protrusion portion protruding in the first direction, the case has a recess portion that fits to the protrusion portion, and a through-hole which penetrates a bottom surface of the recess portion and into which the screw is inserted, the protrusion portion has therein a screw hole fixing the screw, and the adhesive is provided between the protrusion portion and the recess portion.

2. The liquid ejecting head according to claim 1, wherein the adhesive is provided between the through-hole and the screw.

3. The liquid ejecting head according to claim 1, wherein the screw hole has a first portion and a second portion that is closer to an opening of the screw hole than is the first portion, a diameter of the first portion is smaller than a diameter of the second portion, and the adhesive is provided between the screw and the first portion.

4. The liquid ejecting head according to claim 1, wherein the circuit substrate has a second through-hole into which the protrusion portion is inserted, and the adhesive is disposed so as to extend from between the protrusion portion and the recess portion to an inside of the second through-hole, and does not adhere to a surface of the circuit substrate on a second direction side.

5. The liquid ejecting head according to claim 1, wherein the circuit substrate has a second through-hole into which the protrusion portion is inserted, and the adhesive is disposed so as to extend from between the protrusion portion and the recess portion to an inside of the second through-hole, and does not exceed an opening of the second through-hole on a second direction side.

6. The liquid ejecting head according to claim 1, wherein the adhesive does not adhere to a surface of the circuit substrate on a first direction side.

7. The liquid ejecting head according to claim 1, further comprising a flow path forming member provided between the nozzle plate and the case, and defining a third flow path communicating with the first flow path, wherein the adhesive bonding the holder and the case is identical with an adhesive bonding the flow path forming member and the case.

8. The liquid ejecting head according to claim 1, further comprising a COF coupled to the circuit substrate, wherein the circuit substrate has an opening into which the COF is inserted, and a second seal member is provided between the circuit substrate and the holder, at a portion between an outer edge of the circuit substrate and the opening.

9. The liquid ejecting head according to claim 8, wherein the circuit substrate has first and second sides in a fourth direction orthogonal to the first direction, and third and fourth sides in a third direction orthogonal to the first direction and the fourth direction, a distance between the opening and the first side in the third direction and, a distance between the opening and the second side in the third direction are shorter than a distance between the opening and the third side in the fourth direction, and a distance between the opening and the fourth side in the fourth direction, and the second seal member is provided between the first side and the opening in the third direction.

10. The liquid ejecting head according to claim 9, further comprising a third seal member provided between the second side and the opening in the third direction.

11. The liquid ejecting head according to claim 8, wherein the second seal member does not overlap with the nozzles in plan view in the second direction.

12. The liquid ejecting head according to claim 8, wherein the second seal member does not overlap with the flow path pipe in plan view in the second direction.

13. The liquid ejecting head according to claim 8, wherein the holder has the protrusion portion protruding in the first direction, the protrusion portion has therein the screw hole fixing the screw, and the second seal member does not overlap with the protrusion portion in plan view in the second direction.

14. The liquid ejecting head according to claim 8, wherein the second seal member does not overlap with the first seal member in plan view in the second direction.

15. The liquid ejecting head according to claim 8, wherein a circuit element is provided on a surface of the circuit substrate on a second direction side, and the second seal member does not overlap with the circuit element in plan view in the second direction.

16. The liquid ejecting head according to claim 8, wherein a hardness of the second seal member is lower than a hardness of the first seal member.

17. The liquid ejecting head according to claim 8, wherein the second seal member is a double-sided tape.

18. The liquid ejecting head according to claim 1, wherein the case includes a mounting surface on which the circuit substrate is mounted, and the recess portion is recessed in the first direction with respect to the mounting surface of the case.

19. A liquid ejecting apparatus comprising:

the liquid ejecting head according to claim 1; and a liquid storage section storing a liquid to be supplied to the liquid ejecting head.

20. The liquid ejecting apparatus according to claim 19, wherein a direction in which the screw advances when the screw is tightened is a direction opposite to a direction of gravity.

* * * * *